US005332372A

United States Patent [19]

Reynolds

[11] Patent Number: 5,332,372

[45] Date of Patent: Jul. 26, 1994

[54] MODULAR DOUBLE-DIAPHRAGM PUMP

[75] Inventor: Steven M. Reynolds, Mansfield, Ohio

[73] Assignee: Warren Rupp, Inc., Mansfield, Ohio

[21] Appl. No.: 871,191

[22] Filed: Apr. 20, 1992

[51] Int. Cl.[5] ..... F04B 43/06

[52] U.S. Cl. ..... 417/393; 417/395; 417/383; 417/386

[58] Field of Search ..... 417/393, 395, 383, 46, 417/386, 342, 343, 412, 413

[56] References Cited

U.S. PATENT DOCUMENTS

| | | | |
|---|---|---|---|
| 2,491,993 | 5/1947 | Green | 56/256 |
| 2,653,552 | 9/1953 | Geeraert | 417/317 |
| 2,667,129 | 1/1954 | Graner | 417/326 |
| 2,703,055 | 3/1955 | Veth | 417/395 |
| 2,778,315 | 1/1957 | Crookston | 417/383 |
| 3,068,796 | 12/1962 | Pfluger | 137/8 |
| 3,199,531 | 8/1965 | Cornelius | 417/36 |
| 3,637,328 | 1/1972 | Kurokawa | 417/395 |
| 3,782,863 | 1/1974 | Rupp | 417/393 |
| 4,131,397 | 12/1978 | Milgram et al. | 417/404 |
| 4,386,888 | 6/1983 | Verley | 417/393 |
| 4,425,086 | 1/1984 | Peterson | 417/383 |
| 4,470,771 | 9/1984 | Hall | 417/342 |
| 4,472,115 | 8/1984 | Rupp | 417/393 |
| 4,474,204 | 10/1984 | West | 137/88 |
| 4,490,906 | 12/1984 | Box | 417/342 |
| 4,527,954 | 7/1985 | Murali | 417/342 |
| 4,624,628 | 11/1986 | Marchant | 417/393 |
| 4,666,374 | 5/1987 | Nelson | 417/3 |
| 4,701,112 | 10/1987 | Eisenhut | 417/345 |
| 4,810,168 | 10/1987 | Nogami | 417/2 |
| 4,817,503 | 4/1989 | Yamada | 417/395 |
| 4,844,706 | 7/1989 | Katsuyama | 417/395 |
| 4,854,832 | 8/1989 | Gardner | 417/395 |
| 4,895,494 | 1/1990 | Gardner | 417/239 |
| 4,942,735 | 7/1990 | Mushika | 417/395 |
| 5,127,806 | 7/1992 | Benckert | 417/343 |

FOREIGN PATENT DOCUMENTS

| | | | |
|---|---|---|---|
| 9105954 | 5/1991 | World Int. Prop. O. | 417/383 |

*Primary Examiner*—Richard A. Bertsch
*Assistant Examiner*—Peter Korytnyk
*Attorney, Agent, or Firm*—Hill, Steadman & Simpson

[57] ABSTRACT

The fluid-operated, double diaphragm pump of the invention includes a central housing block having opposed side faces, and a pair of diaphragm housing end sections secured to opposite sides of the central housing block. The diaphragm housings define a pair of enclosures having a common central axis. Mounted in each of the diaphragm housings is a diaphragm that serves to divide each enclosure into an inner pumping chamber, defined by a side face of the housing block and the diaphragm, and a drive chamber defined by the opposite side of the diaphragm and, at least in part, by the inner surface of the respective end section. The central housing block defines inlet and discharge passages for the inner pumping chambers, the flow of material through the passages being controlled by one-way check valves associated therewith. In one embodiment of the invention, the pump also includes a connecting arrangement disposed externally of the pumping chambers. The connecting arrangement links the diaphragms to one another for simultaneous flexing movement. A valve assembly is associated with the connecting arrangement, and alternately supplies drive fluid under pressure to the fluid drive chambers, in response to movement of the connecting arrangement. A source of operating fluid pressure and a control valve system are also provided. In another, preferred embodiment, the modular double-diaphragm pump of the present invention includes separate drive mechanisms for each of the flexible diaphragms. Such configuration further reduces the number of parts required for the pump, thus greatly simplifying and facilitating ease of assembly and disassembly of the pump. This configuration also allows the diaphragms of any number of pumps to be controlled independently of one another, thus greatly enhancing the versatility of the system.

34 Claims, 18 Drawing Sheets

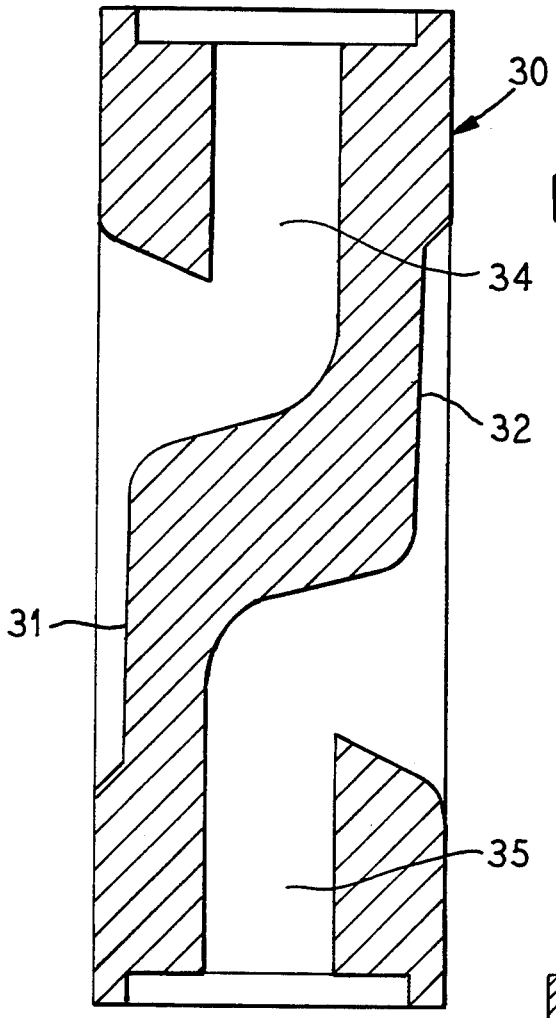
FIG. 6
FIG. 8
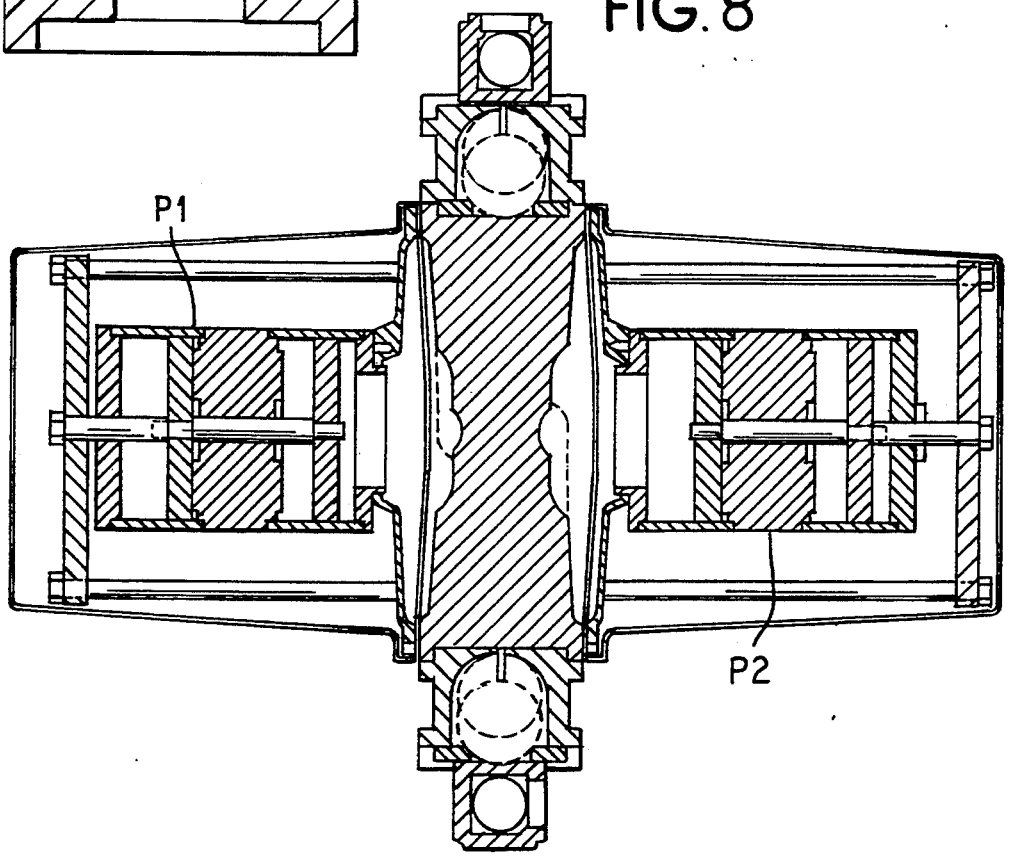

MODULAR DOUBLE-DIAPHRAGM PUMP

TECHNICAL FIELD

This invention relates to fluid-operated reciprocating pumps, and especially to double diaphragm type pumps wherein the two diaphragms reciprocate in reverse phase to generate the pumping action.

BACKGROUND OF THE INVENTION

Fluid-operated pumps, such as diaphragm pumps, are widely used particularly for pumping liquids, solutions, viscous materials, slurries, suspensions or flowable solids. The word "liquid" as used herein is intended to include all such materials. Typical diaphragm pumps of this general type are shown in U.S. Pat. Nos. 3,782,863, 4,131,397, 4,472,115, 4,624,628, and 4,895,494.

Double diaphragm pumps of the type disclosed in the above-listed patents are well known for their utility in pumping viscous or solids-laden liquids, as well as for pumping plain water or other liquids, and high or low viscosity solutions based on such liquids. Accordingly, such double diaphragm pumps have found extensive use in pumping out sumps, shafts, and pits, and generally in handling a great variety of slurries, sludges, and waste-laden liquids. Fluid driven diaphragm pumps offer certain further advantages in convenience, effectiveness, portability, and safety. Double diaphragm pumps are rugged and compact and, to gain maximum flexibility, are often served by a single intake line and deliver liquid through a short manifold to a single discharge line.

In such pumping apparatus, a diaphragm forming a movable wall of a pumping chamber is moved in a suction stroke to draw liquid into the pumping chamber. The diaphragm is then moved in the opposite direction in a pumping stroke to force the liquid out of the pumping chamber by pressurized drive fluid acting directly on the diaphragm.

In double diaphragm pumps in which two diaphragms are connected together, each diaphragm has, on one side, a pumping chamber and, on the other side, a drive fluid chamber. Air or other fluid under pressure is alternately introduced into and exhausted from each drive fluid chamber. A control valve directs the fluid under pressure into one drive fluid chamber, causing the associated diaphragm to move in a pumping stroke, while the connecting mechanism pulls the other diaphragm in a suction stroke and causes air in its associated drive fluid chamber to be exhausted. Then air under pressure is introduced into the other drive fluid chamber to move its diaphragm in a pumping stroke.

Double diaphragm pumps have conventionally used a connecting rod extending coaxially between the two diaphragms. In such arrangements, the drive fluid chambers of each pump section are adjacent to one another, and the pumping sections are spaced outwardly relative to one another. These known pumps, are costly to manufacture, and relatively difficult to disassemble for repair or maintenance. As a result, increased downtime is required for repair or maintenance, significantly increasing the operation costs of the pump system.

SUMMARY OF THE INVENTION

The present invention provides a fluid-operated, double diaphragm pump of greatly simplified construction that is easily disassembled and reassembled, as required.

The fluid-operated, double diaphragm pump of the invention includes a central housing block having opposed side faces, and a pair of diaphragm housing end sections secured to opposite sides of the central housing block. The diaphragm housings define a pair of enclosures having a common central axis. Mounted in each of the diaphragm housings is a diaphragm that serves to divide each enclosure into an inner pumping chamber, defined by a side face of the housing block and the diaphragm, and a drive chamber defined by the opposite side of the diaphragm and, at least in part, by the inner surface of the respective end section.

The central housing block defines inlet and discharge passages for the inner pumping chambers, the flow of material through the passages being controlled by one-way check valves associated therewith.

In one embodiment of the invention, the pump also includes a connecting arrangement disposed externally of the pumping chambers. The connecting arrangement links the diaphragms to one another for simultaneous flexing movement. A valve assembly is associated with the connecting arrangement, and alternately supplies drive fluid under pressure to the fluid drive chambers, in response to movement of the connecting arrangement. A source of operating fluid pressure and a control valve system are also provided.

In another, preferred embodiment, the modular double-diaphragm pump of the present invention includes separate drive mechanisms for each of the flexible diaphragms. Such configuration further reduces the number of parts required for the pump, thus greatly simplifying and facilitating ease of assembly and disassembly of the pump. This configuration also allows the diaphragms to be controlled independently of one another, thus greatly enhancing the versatility of the pump.

Other objects and advantages of the present invention will be apparent upon reference to the accompanying description when taken in conjunction with the following drawings.

BRIEF DESCRIPTION OF THE DRAWINGS

FIG. 6 illustrates a partial sectional view taken generally along line VI—VI of FIG. 4.

FIG. 8 illustrates a sectional view similar to FIG. 2, illustrating a third embodiment of the present invention.

DESCRIPTION OF THE PREFERRED EMBODIMENTS

Figure 1:
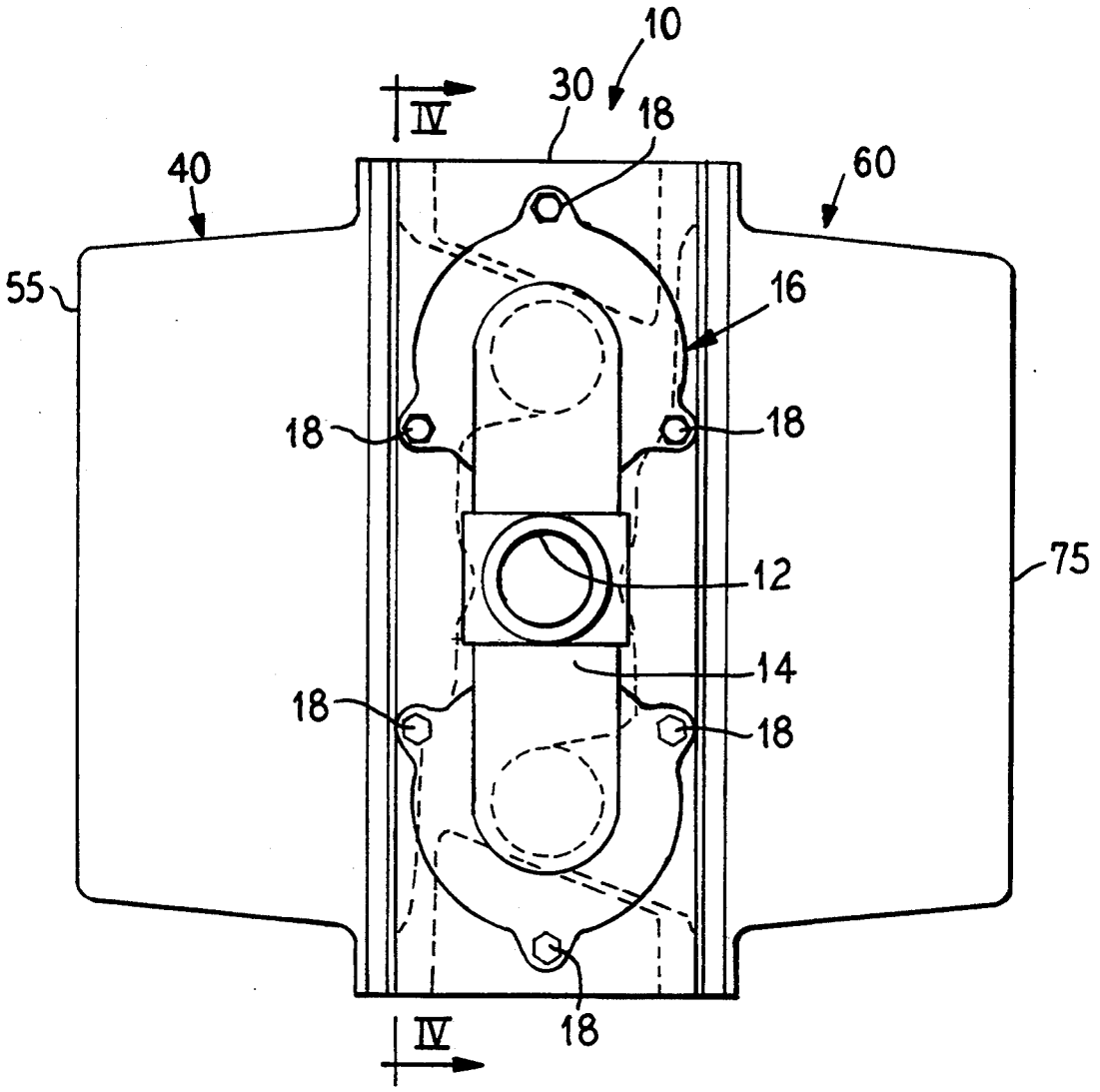
FIG. 1 illustrates a plan view of a double diaphragm pump embodying the principles of the present invention.
Figure 2:
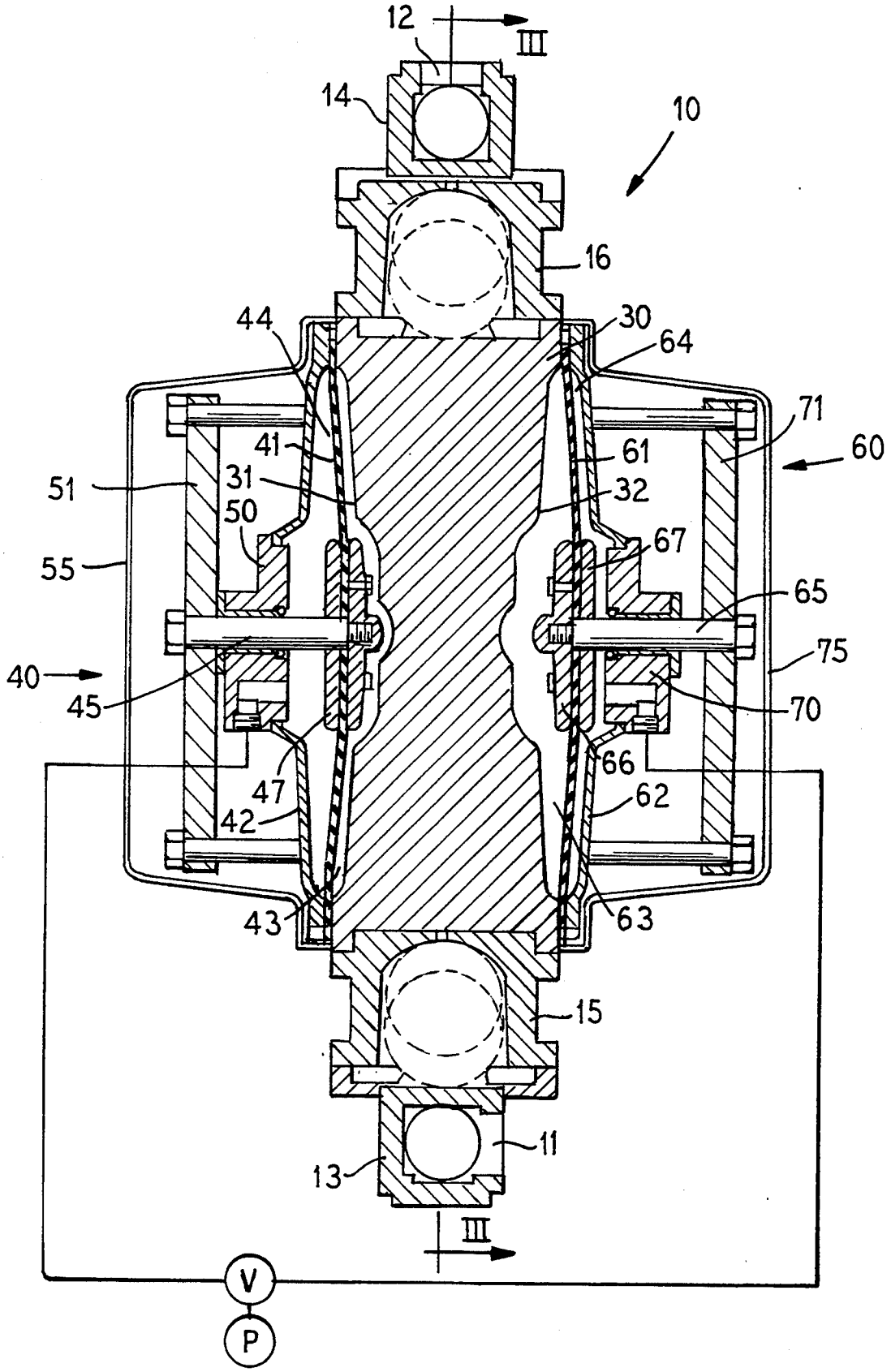
FIG. 2 illustrates a sectional view of the pump illustrated in FIG. 1.

Referring more particularly to the drawings, there is shown in FIGS. 1 through 6 a fluid-operated double diaphragm pump 10 having a fluid inlet 11 (FIG. 2) and a fluid outlet 12 (FIGS. 1 and 2). The fluid inlet 11 is formed in an inlet manifold 13, and the fluid outlet 12 is formed in an outlet manifold 14. The inlet manifold 13 is, in turn, connected to a lower valve housing 15 by machine screws 17. The outlet manifold 14 is connected to an upper valve housing 16 by machine screws 18.

The lower valve housing 15 is secured to the bottom of a main housing block 30 by means of machine screws 19. The upper valve housing 16 is connected to the top of the main housing block 30 by machine screws 20.

The lower valve housing 15 defines a pair of inlet valve chambers 21 and 23. The upper valve housing 16 defines a pair of outlet valve chambers 22 and 24. An inlet ball valve 25 is disposed in the valve chamber 21, and an inlet ball valve 27 is disposed in the valve chamber 23. An outlet ball valve 26 is disposed in the valve chamber 22, and an outlet ball valve 28 is disposed in the valve chamber 24.

The pump 10 also includes a central housing block 30. A pair of pump sections 40 and 60 are disposed on opposite sides of the central housing block 30. The central housing block 30 can be, for example, a casting formed of suitable metal such as cast iron or aluminum or a casting of any suitable non-metallic material. The block 30 has a pair of side faces with recesses 31 and 32 (FIGS. 2 and 4) that are essentially identical in shape.

Figure 3:
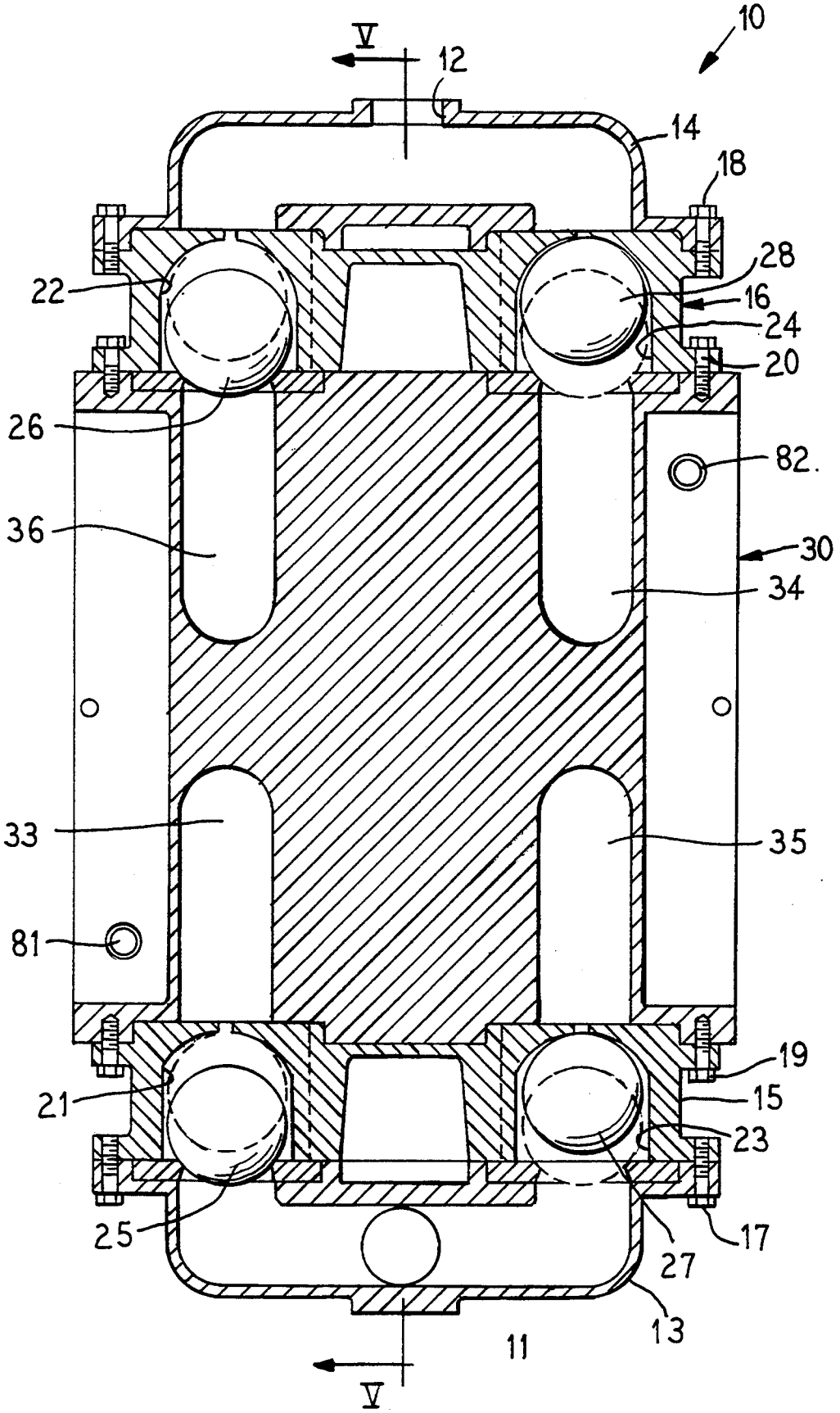
FIG. 3 illustrates a sectional view taken generally along line III—III of FIG. 2.
Figure 4:
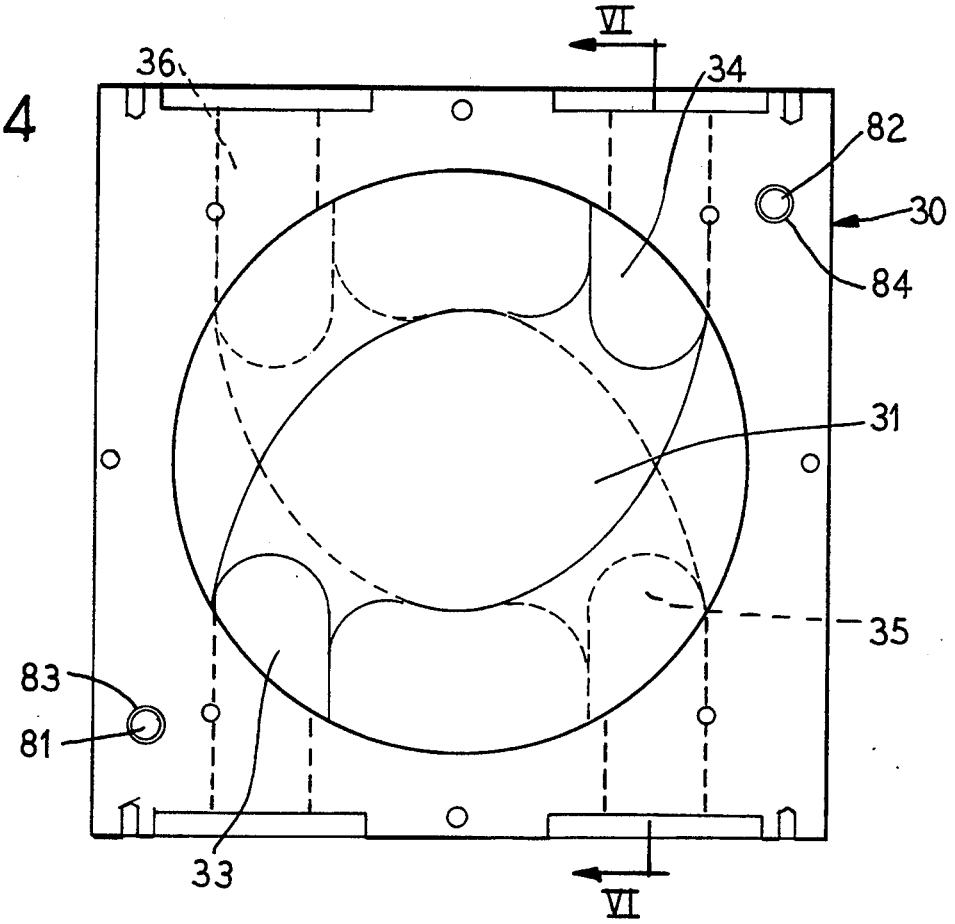
FIG. 4 illustrates a partial sectional view taken generally along line IV—IV of FIG. 1, illustrating an end face of the central housing block.
Figure 5:
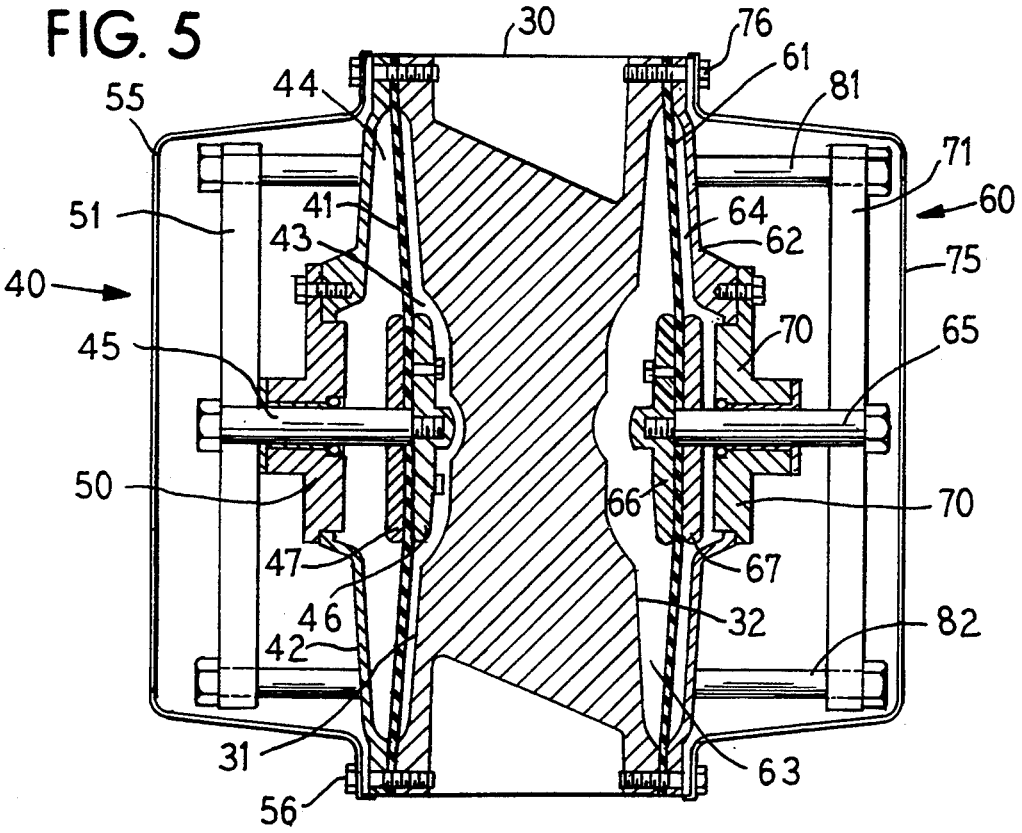
FIG. 5 illustrates a sectional view taken generally along line V—V of FIG. 3.

The block 30 also has an internal inlet passage 33 and an internal outlet passage 34. The inlet passage 33 and the outlet passage 34 communicate with the side face recess 31. The block 30 has an internal inlet passage 35 and an internal outlet passage 36, both of which communicate with the side face recess 32. The geometry of these recesses is best illustrated in FIGS. 2, 3, and 4, as well as in FIG. 6.

The inlet passages 33 and 35 communicate with the inlet valve chambers 21 and 23, respectively, located in the lower valve housing 15. The outlet passages 34 and 36 communicate with the outlet valve chambers 22 and 24, respectively, located in the upper valve housing 16.

A flexible diaphragm 41 is secured in the pump section 40. The diaphragm 41 is contained within a diaphragm housing 42 that is secured to the central housing block 30.

A flexible diaphragm 61 is secured in the pump section 60. The diaphragm 61 is contained within a diaphragm end housing 62 that is secured to the central housing block 30.

The diaphragm housings 42 and 62 define, with the central housing block 30, a pair of diaphragm enclosures.

The diaphragm housing 42 defines, with the central housing block 30, a diaphragm enclosure. The diaphragm enclosure is divided into a pumping chamber 43 defined by the flexible diaphragm 41 and the recess 31, and a drive chamber 44 defined by the flexible diaphragm 41 and an interior surface of the end housing 42. The diaphragm housing 62 defines, with the central housing block 30, a second a diaphragm enclosure. The second diaphragm enclosure is divided into a pumping chamber 63 defined by the flexible diaphragm 61 and the recess 32 of the central housing block, and a drive chamber 64 defined by an interior surface of the diaphragm housing 62 and the flexible diaphragm 61.

The diaphragm 41 is connected to an operating rod 45 by a pair of clamping plates 46 and 47 which are secured to opposite sides of the inner portion of the diaphragm 41. The operating rod 45 has a threaded end portion which is received in a threaded recess in the clamping plate 46. The opposite end of the connecting rod 45 extends through an end block 50 connected to the housing 42. The diaphragm housing 42 has a central opening with a seal surrounding the outer surface of the rod 45. The protruding end of the rod 45 is connected to a connecting bar 51.

An operating rod 65 is connected to the flexible diaphragm 61 by a pair of clamping plates 66 and 67, which are secured to opposite sides of the inner portion of the diaphragm 61. The rod 65 has a threaded inner end that is received in a threaded opening in the plate 66. The opposite end of the rod 65 extends through an end block 70 that is connected to the diaphragm housing 62. The housing 62 has a central opening and a seal provided to seal the operating chamber 64. The outer end of the rod 65 is connected to a connector bar 71 that extends diagonally, as viewed in FIG. 2.

As indicated above, each of the operating rods 45 and 65 is connected to a diagonal bar 51 and 71. The diagonal bars 51, 71 extend diagonally relative to the housing block, from one corner to another within the respective cover plates 55 and 75. The opposite ends of the bars 51 and 71 are connected to one another by a pair of connecting rods 81 and 82 that extend through the corners of the central housing block 30, as best shown in FIGS. 3 and 4. The central housing block has recesses 83 and 84 provided for this purpose. It will be noted from FIG. 2 that the connecting rods 81 and 82 do not extend through any of the pumping chambers 43 and 63, or through the operating chambers 44 and 64. They are located externally of the pumping chambers and thus make the pump easy to assemble and disassemble. The pump can be disassembled, for example, merely by removing the cover plates 55 and 75 and disconnecting the rods 81 and 82 from the bars 51 and 71. This enables either pumping section to be disassembled independently of the other section.

A principal advantage of this construction is that a single casting, namely, the central housing block 30, meets all of the requirements that formerly involved at least two castings. Thus, the size of the pump relative to the volume of the pumping chambers has been reduced significantly, and the unit has an extremely simple construction by comparison with known pumps.

Figure 7:
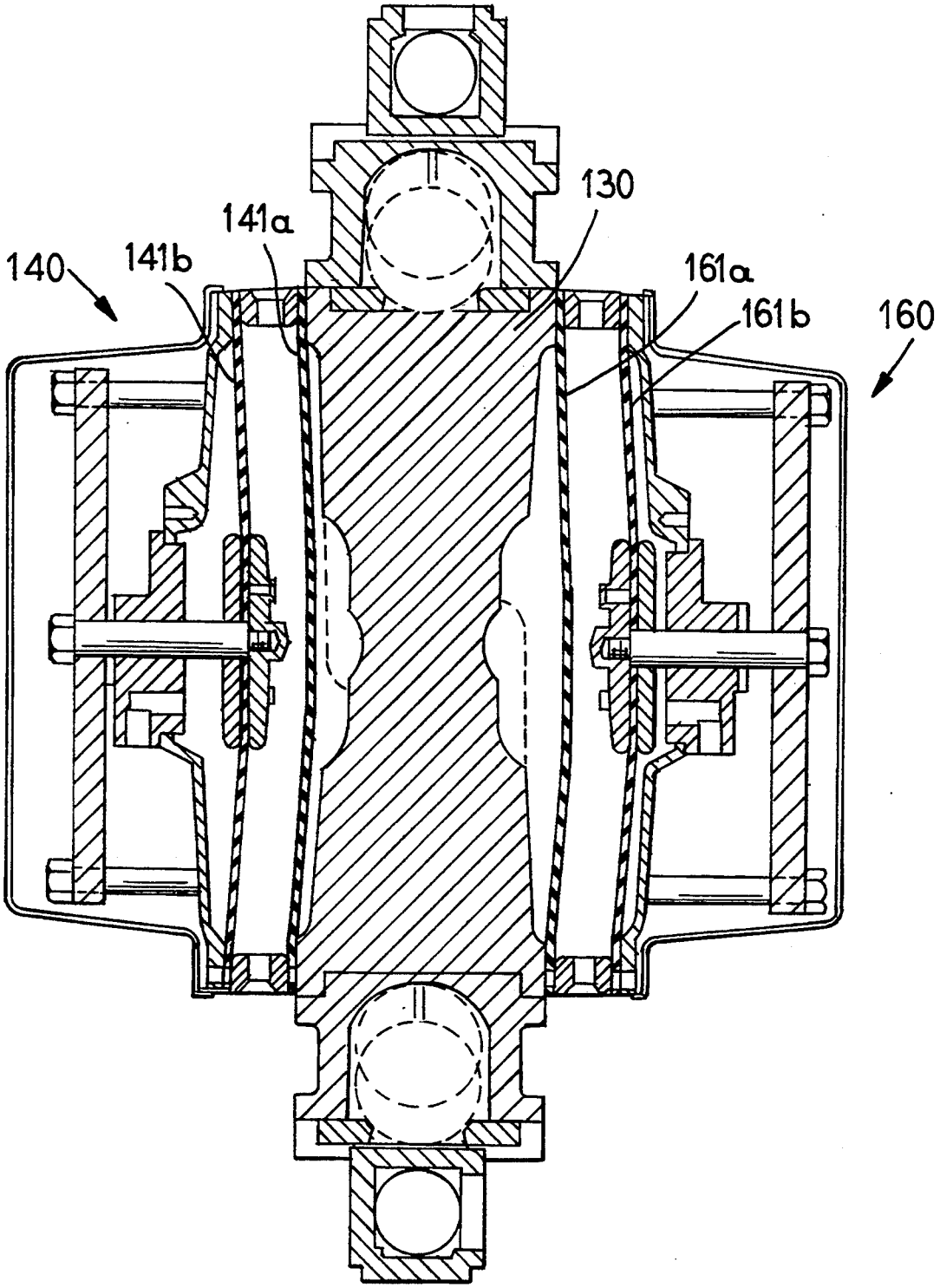
FIG. 7 illustrates a sectional view similar to FIG. 2, illustrating a second embodiment of the present invention.

FIG. 7 illustrates another embodiment of the present invention wherein a similar central housing block 130 is utilized, but wherein the pump sections 140 and 160 each include a pair of diaphragms, mounted in tandem, to achieve greater pumping safety, in that it provided an additional breach barrier in the event of diaphragm failure.

FIG. 8 shows yet another embodiment of the present invention, wherein the diaphragms are driven by fluid pressure from a pair of fluid cylinders, each of which has one or two pistons. In the double-piston arrangement shown, greater pumping force may be generated, since the operating fluid pressure is applied to a larger piston area. This configuration includes dual diaphragms similar to those described with reference to FIG. 7.

Figure 9:
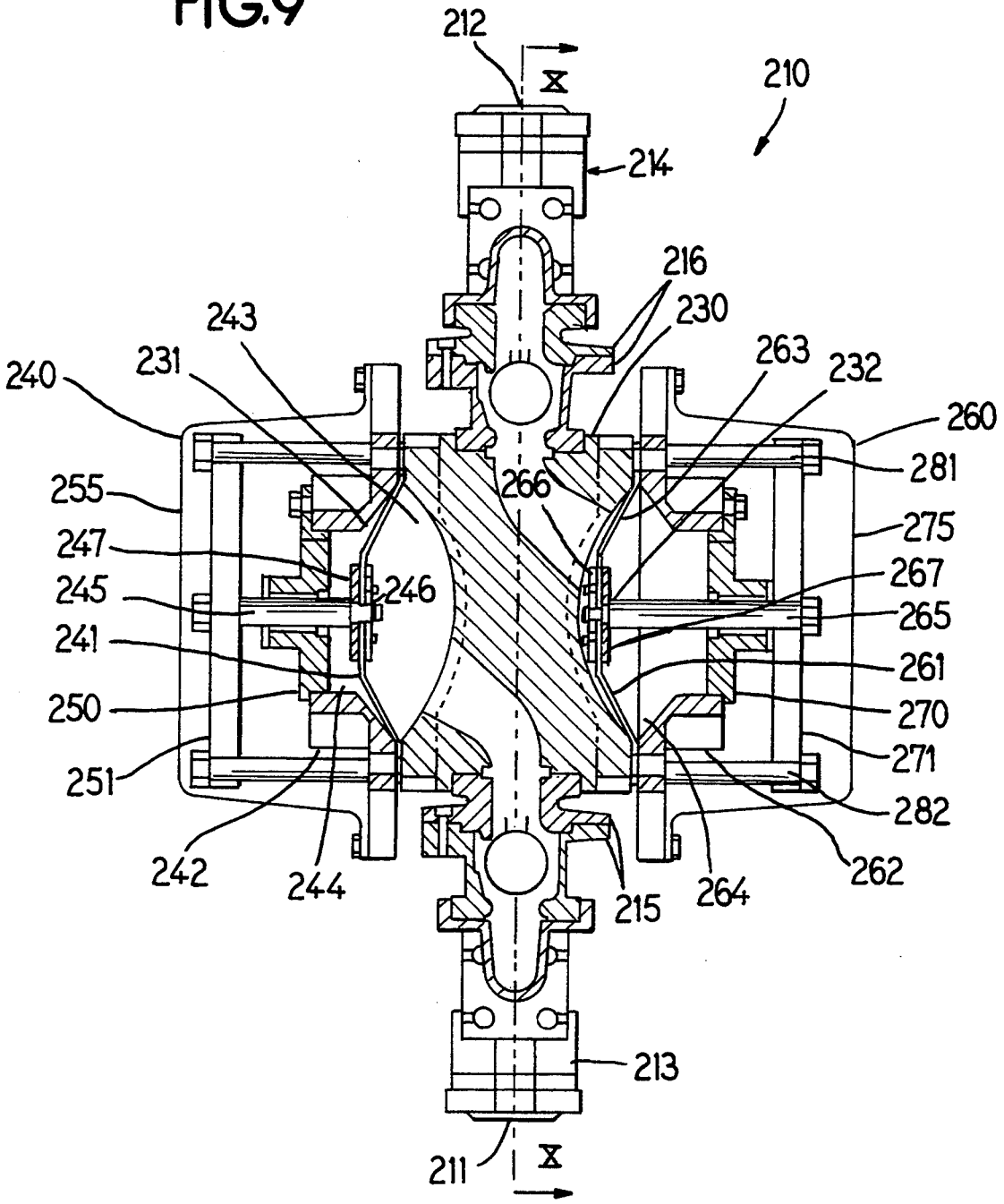
FIG. 9 illustrates a sectional view of another embodiment of a pump according to the present invention.

FIGS. 9 through 14 illustrate additional embodiments of fluid-operated double diaphragm pumps according to the present invention. In FIG. 9, a pump 210 includes a fluid inlet 211 and a fluid outlet 212 (FIGS. 9, 10, 11 & 12). The fluid inlet 211 is formed in an inlet manifold 213, and the fluid outlet 212 is formed in an outlet manifold 214. The inlet manifold 213 is, in turn, connected to a lower valve housing 215 by machine screws 217 or other suitable securing mechanisms (FIG. 2). The outlet manifold 214 is connected to an upper valve housing 216 by machine screws 218 or other suitable securing mechanisms (FIG. 2). The lower valve housing 215 and upper valve housing 216 are identical in construction, but act in an inlet or outlet capacity by virtue of their attached valve construction, to be described below.

Figure 10:
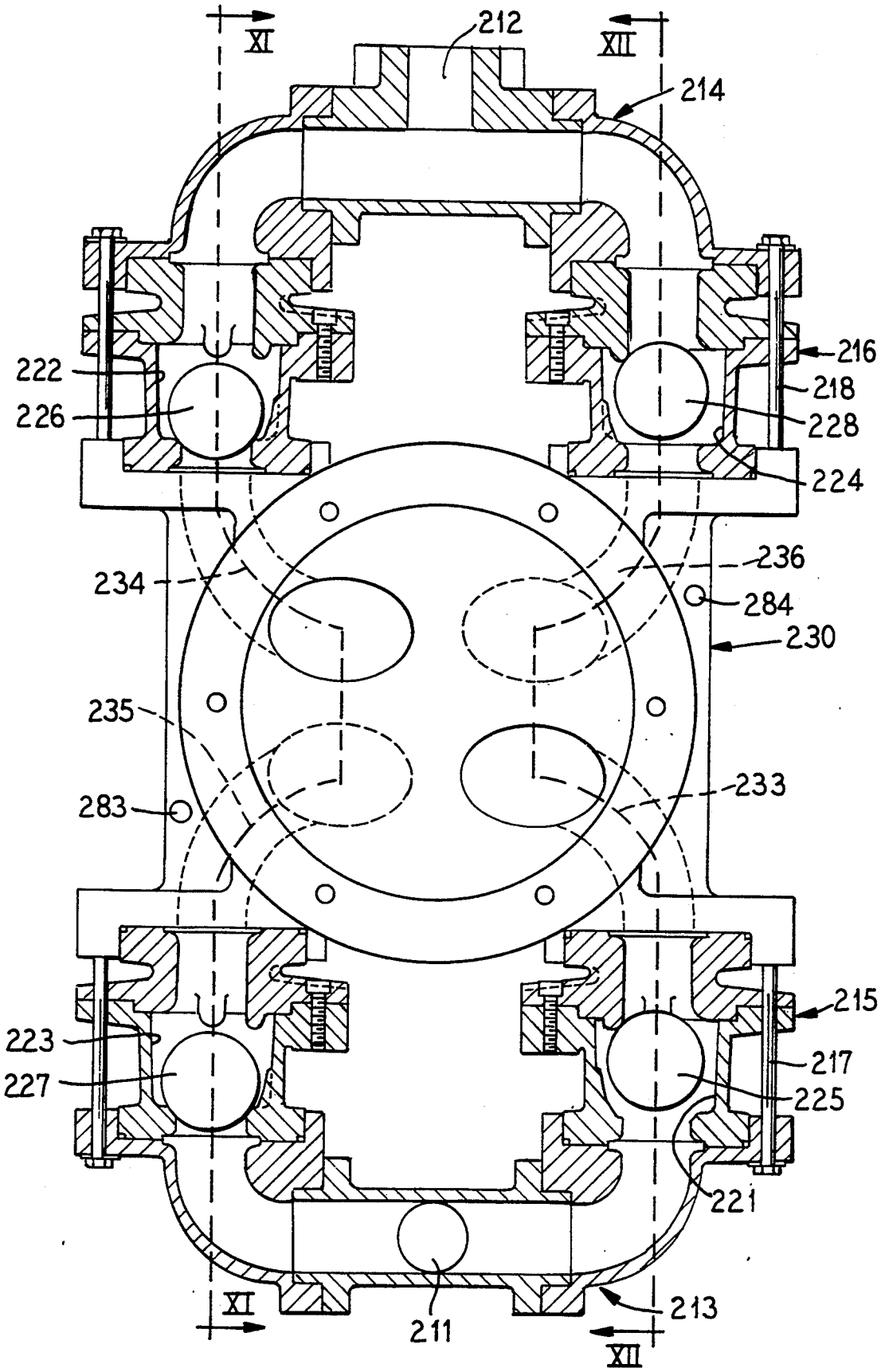
FIG. 10 illustrates a sectional view taken generally along line X—X of FIG. 9.
Figure 11:
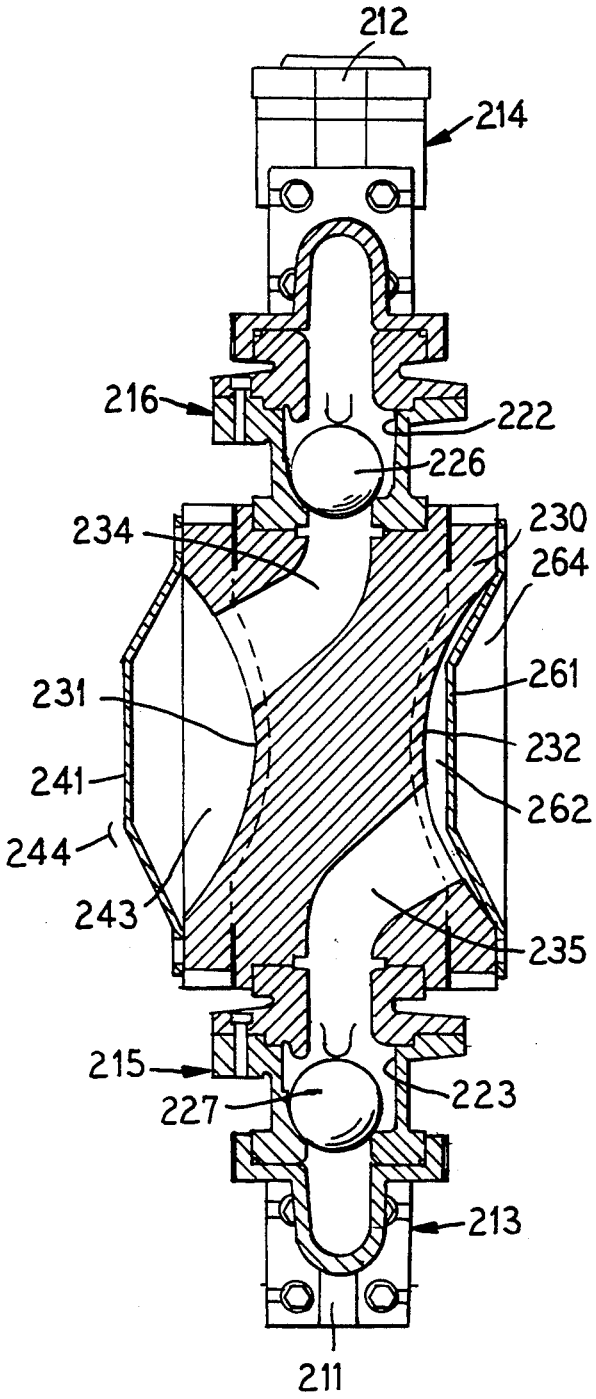
FIG. 11 illustrates a sectional view taken generally along line XI—XI of FIG. 2 illustrating an end section of the pump through a vertical axis.
Figure 12:
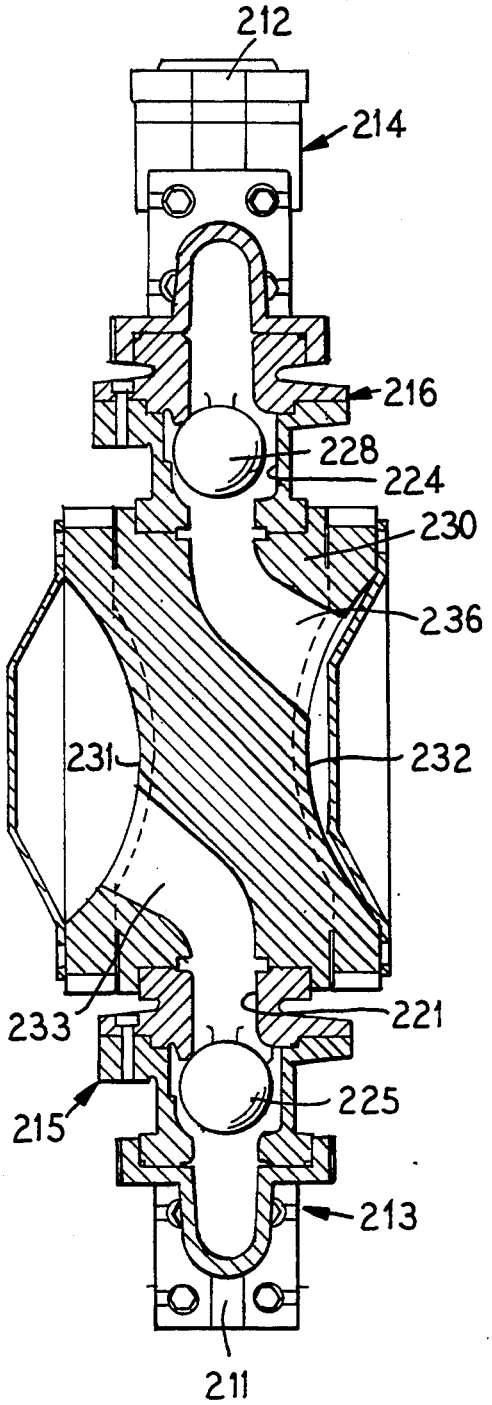
FIG. 12 illustrates a sectional view taken generally along line XII—XII of FIG. 2 illustrating an end section of the pump through a vertical axis.

The lower valve housing 215 defines a pair of inlet valve chambers 221 and 223. The upper valve housing 216 defines a pair of outlet valve chambers 222 and 224. An inlet ball valve 225 is disposed in the valve chamber 221, and an inlet ball valve 227 is disposed in the valve chamber 223. An outlet ball valve 226 is disposed in the valve chamber 222, and an outlet ball valve 228 is disposed in the valve chamber 224 (FIGS. 10, 11 & 12).

The pump 210 also includes a central housing block 230 (FIGS. 9 through 12). A pair of pump sections 240 and 260 are disposed on opposite sides of the central housing block 230. The central housing block 230 can be, for example, a casting formed of suitable metal such as cast iron or aluminum, or can be otherwise fabricated from a suitable non-metallic material. The central housing block 230 has a pair of side faces with recesses 231 and 232 (FIGS. 9, 11 & 12) that are essentially identical in shape.

The central housing block 230 has internal inlet passages 233 and 235 and internal outlet passages 234 and 236. The inlet passage 233 and the outlet passage 234 communicate with the side face recess 231. The inlet passage 235 and the outlet passage 236 communicate with the side face recess 232. The geometry of these recesses is best illustrated in FIGS. 9, 11 and 12.

The inlet passages 233 and 235 communicate with the inlet valve chambers 221 and 223, respectively, located in the lower valve housings 215. The outlet passages 234 and 236 communicate with the outlet valve chambers 222 and 224, respectively, located in the upper valve housings 216 (FIGS. 11 & 12). A flexible diaphragm 241 is secured in the pump section 240. The diaphragm 241 is contained within a diaphragm housing 242 that is secured to the central housing block 230.

A flexible diaphragm 261 is secured in the pump section 260. The diaphragm 261 is contained within a diaphragm housing 262 that is secured to the central housing block 230.

The diaphragm housings 242 and 262 define, with the central housing block 230 a pair of diaphragm enclosures.

The diaphragm enclosure, in pump section 240, is divided into a pumping chamber 243 defined by the flexible diaphragm 241 and the recess 231, and a drive chamber 244 defined by the flexible diaphragm 241 and an interior surface of the diaphragm housing 242.

The diaphragm housing 262, in pump section 260, defines with the central housing block 230 a second diaphragm enclosure. The second diaphragm enclosure is divided into a pumping chamber 262 defined by the flexible diaphragm 261 and the recess 232 of the central housing block. A drive chamber 264 is defined by an interior surface of the diaphragm housing 262 and the flexible diaphragm 261.

The diaphragm 241 is connected to an operating rod 245 by a pair of clamping plates 246 and 247 which are secured to opposite sides of the center portion of the diaphragm 241. The operating rod 245 has a threaded end portion which is received in a threaded recess in the clamping plate 246. The opposite end of the connecting rod 245 extends through an end block 250 connected to the diaphragm housing 242. The diaphragm housing 242 has a central opening with a seal surrounding the outer surface of the operating rod 245. The protruding end of the rod 245 is connected to a connector bar 251.

An operating rod 265 is connected to the flexible diaphragm 261 by a pair of clamping plates 266 and 267, which are secured to opposite sides of the center portion of the diaphragm 261.

The rod 265 has a threaded inner end that is received in a threaded recess in the plate 266. The opposite end of the rod 265 extends through an end block 270 that is connected to the diaphragm housing 262. The diaphragm housing 262 has a central opening and a seal provided to seal the drive chamber 264. The outer end of the rod 265 is connected to a connector bar 271 that extends diagonally, as viewed in FIG. 9.

As indicated above, each of the operating rods 245 and 265 is connected to a diagonal connector bar 251 and 271. The diagonal connector bars 251 and 271 extend diagonally relative to the housing block, from one corner to another within the respective cover plate 255 and 275. The opposite ends of the connector bars 251 and 271 are connected to one another by a pair of connecting rods 281 and 282 that extend through the corners of the main housing block 230 as best shown in FIG. 10. The central housing block has recesses 283 and 264 (FIG. 11) provided for this purpose. It will be noted from FIG. 11 that the connecting rods 281 and 282 do not extend through any of the pumping chambers 243 and 263, or through the drive chambers 244 and 264. The connecting rods are located externally of the pumping chambers and thus make the pump easy to assemble and disassemble. The pump can be disassembled, for example, merely by removing the cover plates 255 and 275 and disconnecting the connecting rods 281 and 282 from the connector bars 251 and 271. This enables either pumping section to be disassembled independently of the other section.

Exemplary operation of the pump 210 is as follows. When the pump 210 is actuated, the drive chamber 264 is pressurized, thus causing the diaphragm 261 to flex to the position shown in FIGS. 11 and 12. This movement pressurizes the pumping chamber 262. Pressurization of the pumping chamber 262 acts through the passage 235 to move the inlet ball valve 227 to its closed position (FIG. 11), and through the passage 236 to move the outlet ball valve 228 to its open position (FIG. 12). With the ball valve elements in these positions, fluid is prevented from flowing from the pump chamber 262 back to the fluid inlet 211, and allowed to flow from the pump chamber 262 to the fluid outlet 12. This represents the "pumping stroke" of this side of the pump.

By contrast, the flexible diaphragm 241 is shown in a "suction stroke". In this position, the pump chamber 243 is depressurized, acting through the passage 234 to move the outlet ball valve 226 to its closed position (FIG. 11), and through the inlet passage 233 to move the inlet ball valve 225 to its open position (FIG. 12). This draws fluid from the fluid inlet 211 into the pump chamber 243, while preventing fluid from the pump outlet 212 from entering the pump chamber 243.

A principal advantage of the construction is that a single casting, namely, the central housing block 230, meets all of the requirements that formerly involved at least two castings. Thus, the size of the pump relative to the volume of the pumping chambers has been reduced significantly, and the unit has an extremely simple construction by comparison with known pumps.

Figure 13:
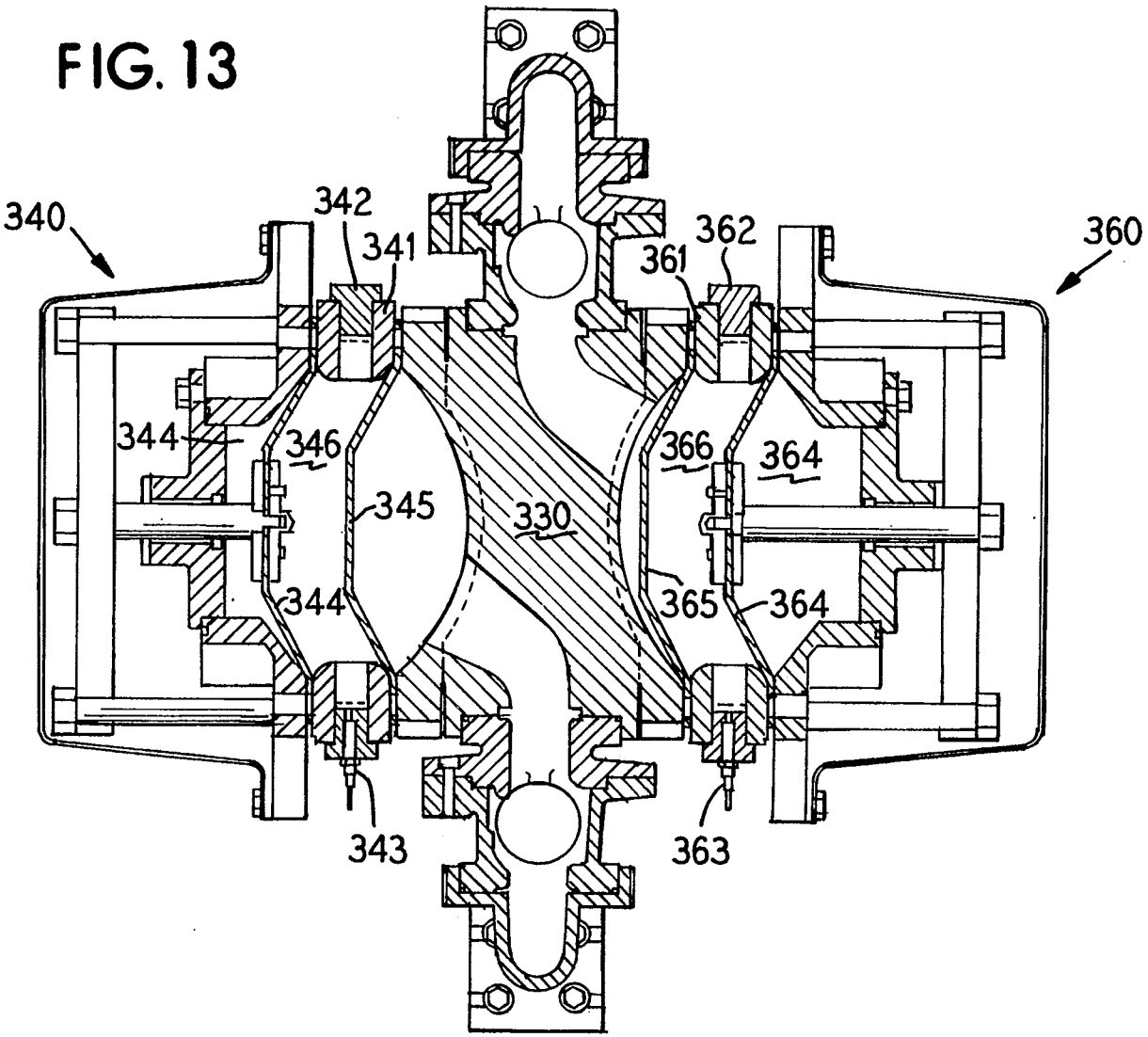
FIG. 13 illustrates a sectional view of another embodiment similar to the pump illustrated in FIG. 9.

FIG. 13 illustrates another embodiment of the present invention wherein a similar central housing block 230, is utilized. Pump sections 340 and 360 include primary diaphragms 345 and 365, secondary diaphragms 344 and 364 and spill containment chambers 341 and 361. Driver fluid is added through the chamber fill plugs 342 and 362 into the driver fluid chambers 346 and 366, between the primary diaphragms 345 and 365 and the secondary diaphragms 344 and 364. Plugs with leak detectors 343 and 363 are installed 180 degrees from fill plugs 342 and 362. In the event of a primary diaphragm failure, the leak detector would signal a replacement of the driver fluid by the pumped product, immediately notifying the user of a possible failure.

Figure 14:
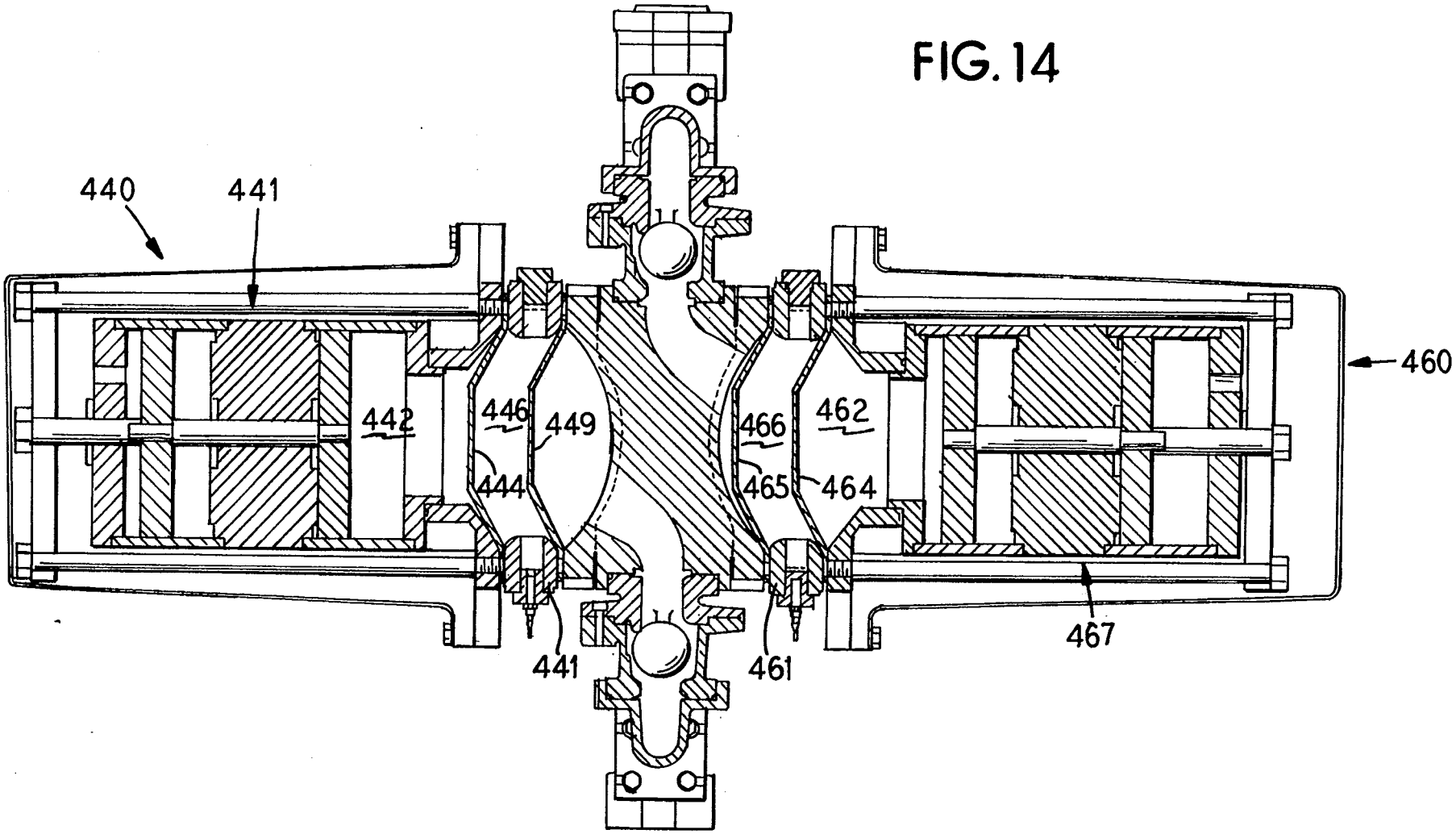
FIG. 14 illustrates a sectional view of another embodiment similar to the pump in FIGS. 9 and 13.
Figure 15:
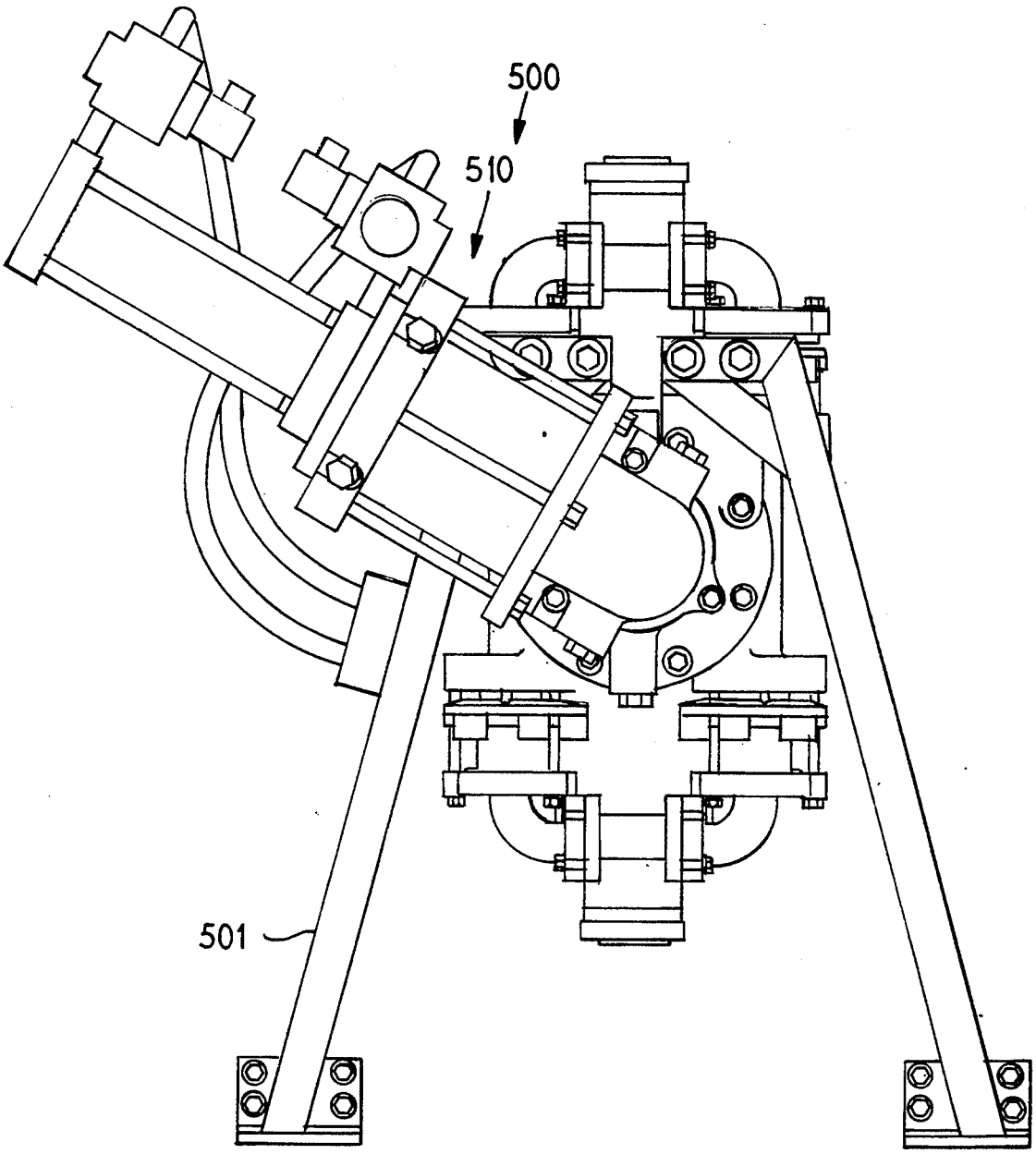
FIG. 15 illustrates an elevational view of another, preferred embodiment of the present invention.

FIG. 14 illustrates another embodiment of the present invention. Pump sections 440 and 460 employ the same spill containment chamber primary-secondary diaphragm concepts as shown in FIG. 13 with the addition of driver piston assemblies 441 and 461. The piston assemblies reciprocate, using the primary driver fluid chamber 442 and 462 to actuate the secondary driver fluid chambers 446 and 466. With the addition of the driver piston assemblies 441 and 461 the pumps performance is increased. Greater pumping forces are generated due to driver fluid pressure being applied to a larger piston area.

FIGS. 15 through 20 illustrate yet another embodiment of the present invention, in which separate drive mechanisms are provided for each of the diaphragms. This embodiment represents the best mode for practicing the invention currently contemplated by the inventors.

Figure 16:
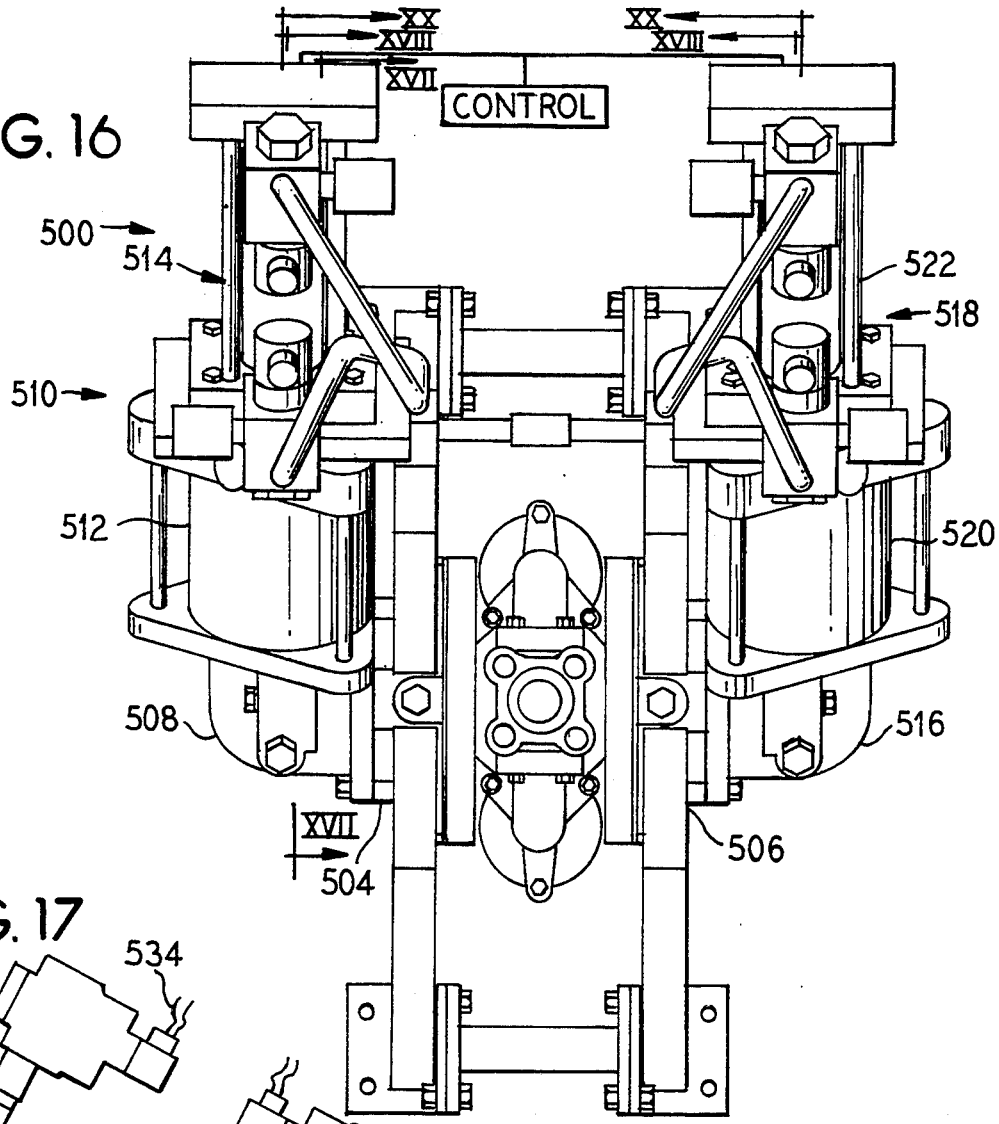
FIG. 16 illustrates a plan view of the embodiment illustrated in FIG. 15.

FIGS. 15 through 20 illustrate a pump 500. The pump 500 is mounted on a frame assembly 501 (FIGS. 15 and 16), and includes a central housing block 502, with a pair of diaphragm housings (504, 506) secured to respective sides of the central housing block (FIG. 16). A drive passage 508 is secured between the diaphragm housing 504 and a drive assembly 510. The drive assembly 510 includes a piston assembly 512 that is driven by a multiple-stage cylinder assembly 514.

Similarly, a drive passage 516 connects the diaphragm housing 506 to a second drive assembly 518. The drive assembly 518 includes a piston assembly 520 driven by a multiple-stage cylinder assembly 522. The cylinder assemblies 514, 522 may be provided, for example, as MULTI-POWER cylinders manufactured by FABCO-AIR. The cylinder assemblies 514, 522 are controlled by a control mechanism 524, which can be an electronic control mechanism, for example, a microprocessor.

Figure 17:
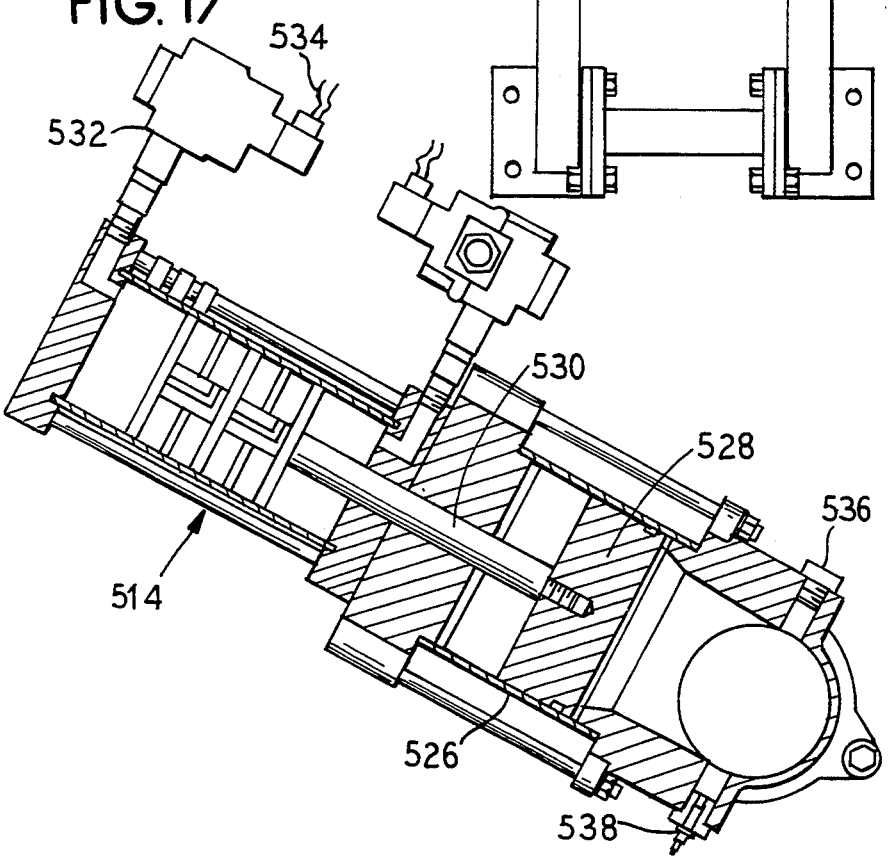
FIG. 17 illustrates a sectional view taken generally along lines XVII—XVII of FIG. 16.

FIG. 17 illustrates a sectional view of the drive assembly 510. The piston assembly 512 of the drive assembly 510 includes an annular cylinder 526 secured to the drive passage 508. A piston 528 is mounted for reciprocation within the cylinder 526, and is actuated by the multiple-stage cylinder assembly 514 through a piston rod 530 secured between the multiple-stage cylinder assembly 514 and the piston 528. A pair of control valves 532 are connected to the control mechanism 524 via leads 534. Although the control switches are shown as 2-way solenoid valves, it is contemplated that any suitable switching mechanism can be provided. For example, the control valves 532 could be provided as digital modulating valve assemblies, thus increasing the available degree of system control. The inputs of the control valves 532 are connected to a source of pressurized fluid, e.g. shop air. The outputs of the control valves 532 are connected in fluid communication with the interior of the cylinder assembly 514 via ports 515 at each end of the cylinder assembly. The control mechanism 524 acts through the solenoid control switches 532 to selectively actuate the actuator piston assembly 515 cylinder assembly 514, which in turn controls the stroke of the piston 528.

Figure 18:
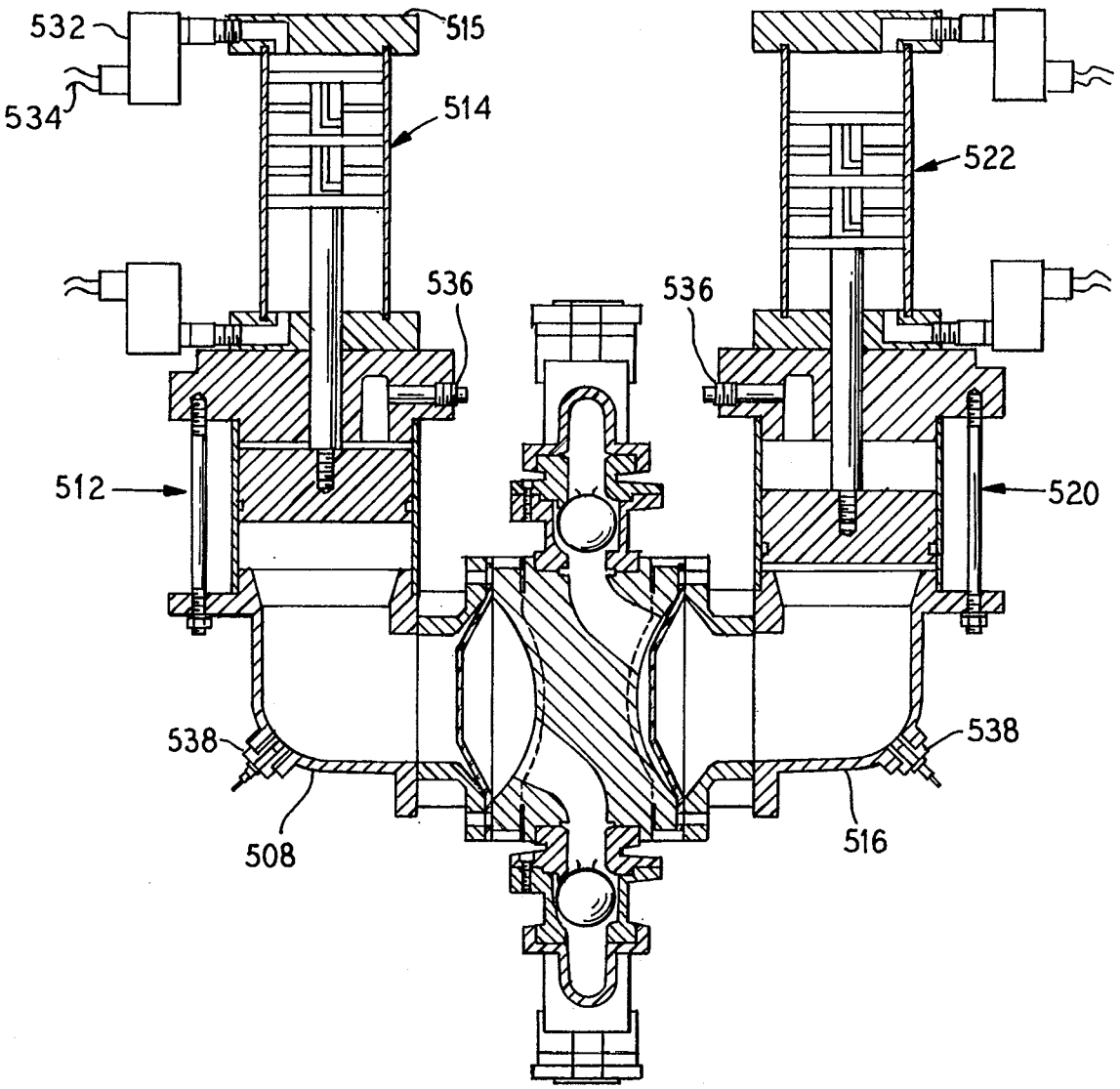
FIG. 18 illustrates a sectional view taken generally along lines XVIII—XVIII of FIG. 16.

As shown in FIG. 18, the drive passages 508, 516 include fill plugs 536 with leak detectors 538. Driver fluid is added through the chamber fill plugs 536. Plugs with leak detectors 538 are installed 180 degrees from the fill plugs 536. In the event of a primary diaphragm failure, the leak detector would signal a replacement of the driver fluid by the pumped product, immediately notifying the user of a possible failure.

The control mechanism 524 acts through the control switches 532 to selectively actuate the solenoid 514, which in turn controls the stroke of the piston 528.

Figure 19:
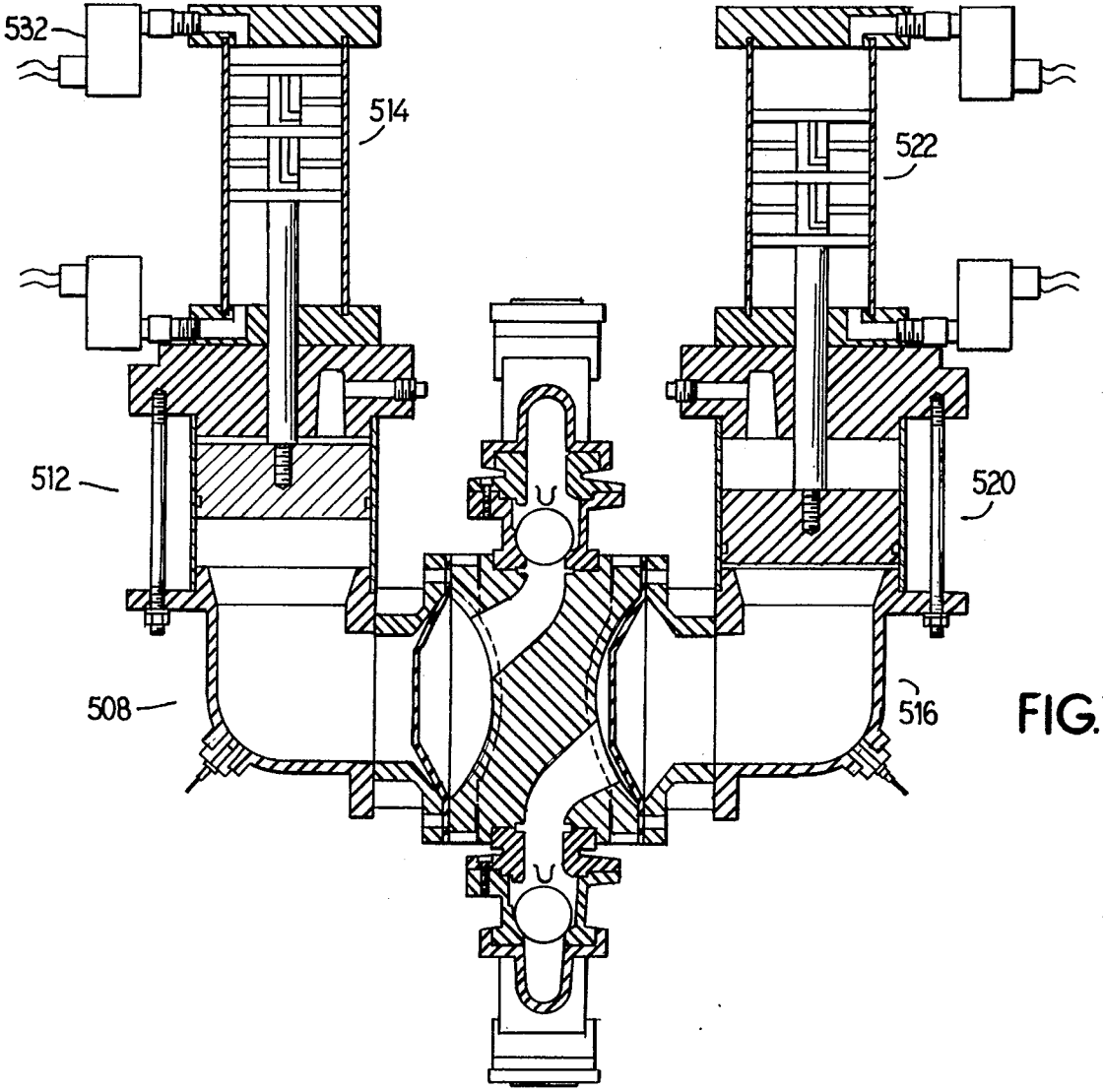
FIG. 19 illustrates a sectional view taken generally along lines XIX—XIX of FIG. 16.

In operation, the control mechanism 524 is caused to generate a signal to the solenoid switches to actuate the cylinder assemblies to drive the pistons in the directions indicated in FIGS. 18 and 19. This represents the pumping stroke of one side of the pump, and the suction stroke of the other side of the pump. The valves and diaphragms of the respective pump sides operate in accordance with the description set forth with reference to FIGS. 10 through 12 hereinabove.

Figure 20:
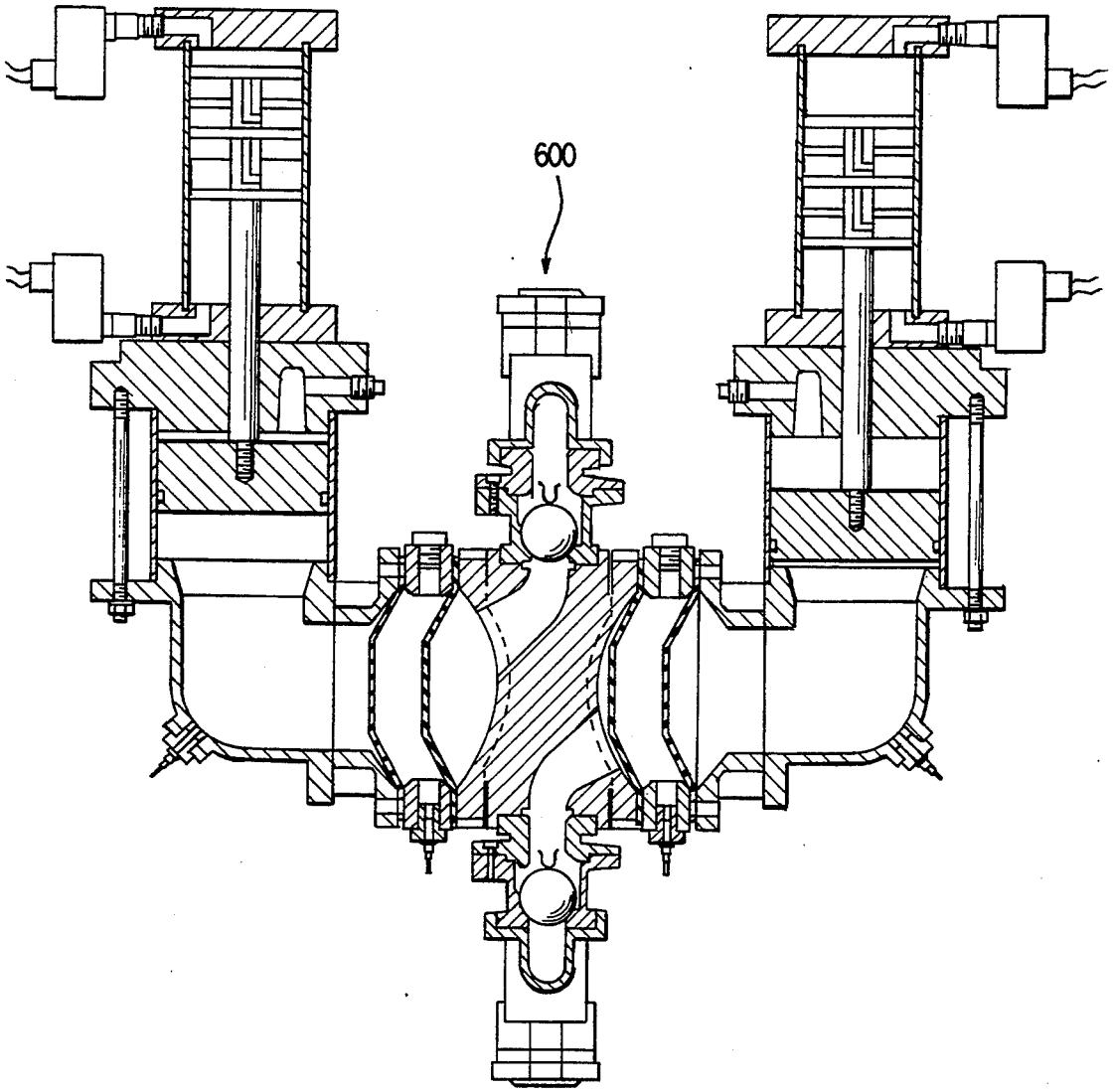
FIG. 20 illustrates a sectional view of another embodiment of the present invention.

FIG. 20 illustrates a pump assembly 600. The pump assembly 600 differs from the pump assembly 500 only in that it is provided with a dual-diaphragm arrangement, the advantages of which are discussed hereinabove with respect to the FIG. 7 embodiment.

As stated hereinabove, the arrangements shown in FIGS. 15 through 20 allow the pump diaphragms to be actuated separately and independently, thus greatly increasing the potential versatility of the pump. This versatility can be further enhanced by "multiplexing" a plurality of dual-diaphragm pumps, and using a central controller to monitor and individually actuate each of the pumps.

Figure 21:
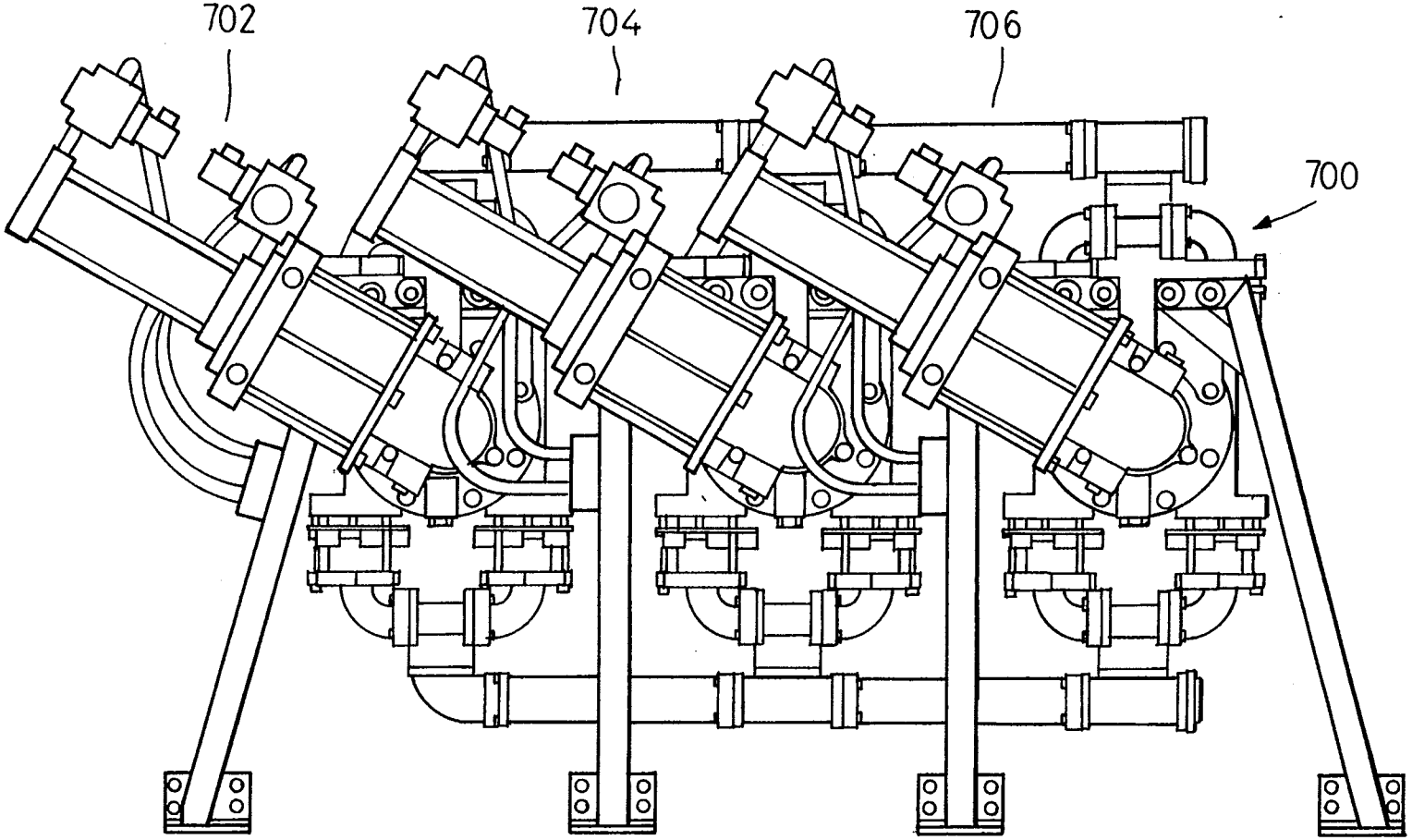
FIG. 21 illustrates an elevational view of another, preferred embodiment of the present invention.

FIG. 21 illustrates a "gang" 700 of multiplexed pumps. The gang 700 includes three serially connected fluid-operated double diaphragm pumps 702, 704, and 706. Each of the pumps 702, 704, 706 is similar to the pump described with reference to FIGS. 15 through 19, including respective with pistons mounted for reciprocation within cylinders.

Figure 22:
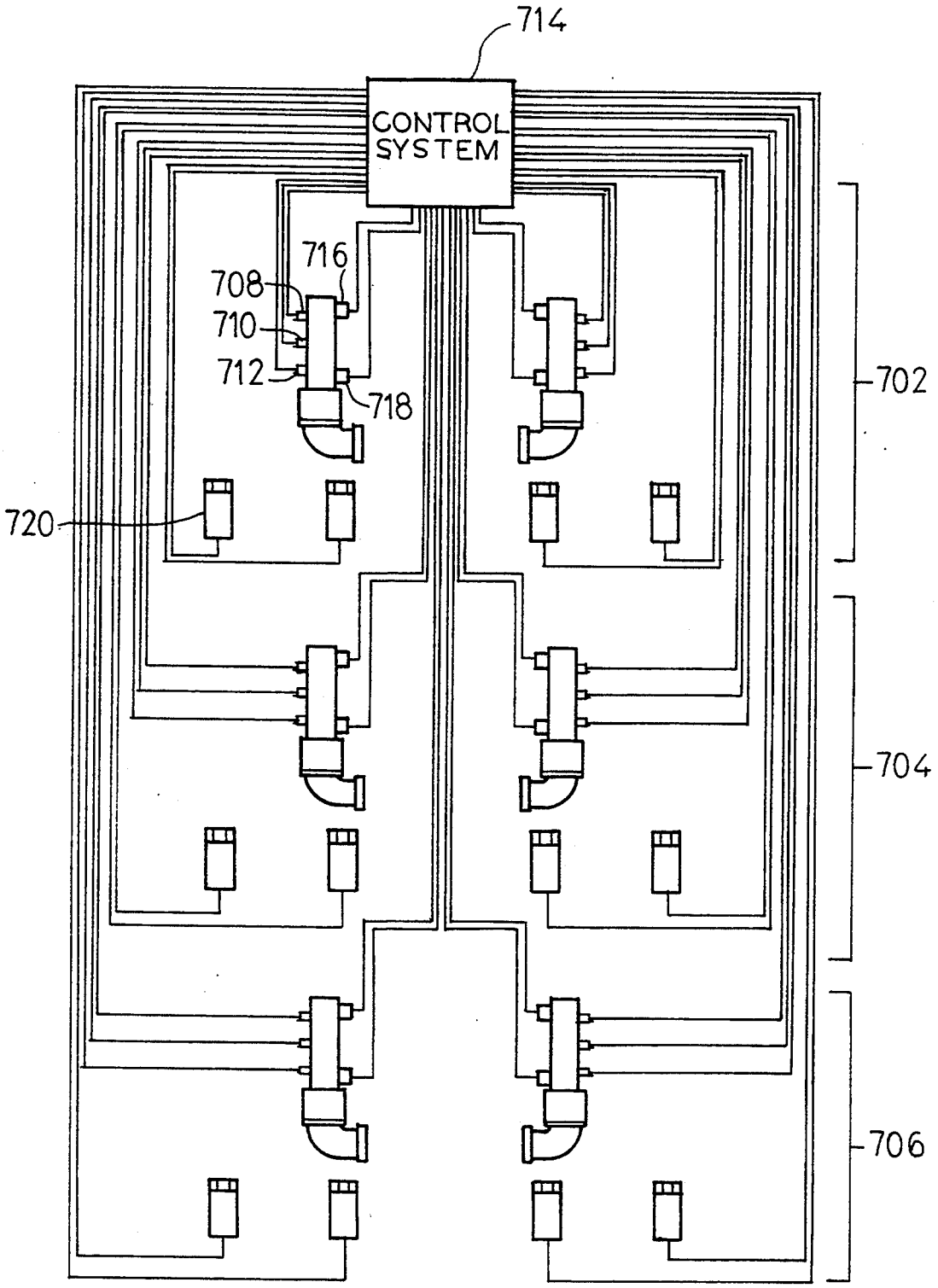
FIG. 22 illustrates a schematic diagram of a multi-pump control system in accordance with the principles of the present invention.

As illustrated in FIG. 22, the drive assemblies for each of the pumps 702, 704, 706 include stroke position sensors 708, 710, 712 mounted on the cylinders of the respective drive assemblies. The stroke position sensors 708, 710, 712 generate signals representing the position of the respective actuator pistons, and transmit the signals to a control system 714. The control system 714 is capable of actuating the pump drive assemblies, as described with reference to FIGS. 15 through 19, at any point along their respective strokes by selectively actuating control valves 716, 718 provided on the actuator cylinders of the respective pumps. The control system 714 may be provided as a microprocessor control system, for example, as a control driver such as the BOSS BEAR programmable integrated multi-control system, model PIMS-EX-BBS-XX-Y marketed by Divelbiss Corp.

Although the illustrated embodiment shows the use of three position sensors, it is also contemplated that any suitable number of sensors, or a single, continuous sensor, could be provided on each cylinder. For example, the piston shafts in the drive assemblies can be digitally encoded to provide a precise signal corresponding to piston location. Any of the above-mentioned arrangements provide a signal to detect changes in piston speed and piston position.

The control system 714 is also in communication with a plurality of flow condition sensors 720. The flow condition sensors 720 can be placed in the drive section of the pump, or at either the input sides, the output sides, or both, of the respective pumps. The specific nature of the flow condition sensors 720 will depend upon the specific critical characteristics of the pump system. For example, if leakage is a critical consideration in the system, the sensors 720 can be provided as leak detectors. Similarly, if flow rate is a critical consideration in the system, the sensors 720 can be provided as flow meters; if slurry concentration is critical, the sensors 720 can be provided as piezo sensors, and so on.

In operation, the desired optimal pump conditions are programmed into the control system 714. When the pump system is subsequently actuated, the control system could thereafter (using information from the stroke position sensors 708, 710, 712 and from the flow condition sensors 720) experiment with different stroke lengths, stroke speeds, and onset of pumping cycle to determine the optimal pump actuation sequence to achieve and maintain the desired predetermined pumping conditions. The constant feedback provided by the sensors allows the system to adjust immediately to changing operating conditions without interrupting pump operation. For example, if a predetermined flow rate is specified for a pumped medium having a predetermined viscosity, the control system can adjust the piston actuation sequence and piston travel speed to maintain a predetermined throughput volume per unit time of pumped medium.

It will be understood by those skilled in the art from the above-description that the control capabilities of this invention are modifiable to achieve substantially any desired result. By utilizing a structure where the position of the drive piston can be sensed by sensing the position of the actuator piston (which is mechanically coupled to the drive piston), it becomes possible to control the drive piston in numerous ways. In the embodiments illustrated, the actuator system is provided as a double stroke cylinder which has each end coupled to a pressure source (which may, for example, be factory air, an hydraulic power pack, or even municipal water pressure). Electronically controlled valves are utilized to control the application of fluid pressure to either end of the actuator cylinder. Such valve controls may be variable either with respect to pressure, flow rate, or both, and the variability may range between a single on-off valve, or a precise meter-in/meter-out arrangement. The ultimate control system may be provided with means to provide for fine variability of the state of the valves or in simpler systems, the valves may merely be cycled between vent and pressure. By determining the position of the actuator piston, the valves can be controlled for purposes as simple as eliminating pulsing in a gang of pumps by actuating the drive stroke of a second pump as the piston position of a first pump is sensed to be at, or adjacent to, top dead center. Alternatively, by sensing the delta position of the piston, the control can modify the settings of the valves associated with that piston to control both speed of the piston or driving pressure. Most importantly, stroke direction can be controlled and changed substantially instantaneously during operation of the system.

It is within the contemplation of this invention that the position of the actuator piston will be sensed at a plurality of points along the length of the cylinder or constantly sensed. The ability to independently control the individual pump actuators in response to piston position, piston speed, and flow conditions provides for a heretofore unknown degree of control to facilitate response to for whatever variable is important in the system. For example, by sensing flow on the output side of the pump and by controlling speed of the actuator piston, it is possible to control flow within a desired range or even to maintain flow at a desired rate. By sensing pressure, either on the output side of the pump or through the driver fluid, and by controlling driving pressure through a pressure control valve, it is possible to maintain a continuous set pressure level in the output side.

The control system described can be used to control a single pump, or any number of pumps connected to a common output. However, by ganging a series of pumps, each of which is provided with the control features taught herein, it will be appreciated by those skilled in the art that both throughput and pressure can be continuously monitored and maintained at any desired level without pulsing and irrespective of variations in other conditions such as changes in factory air pressure, viscosity of pumped material, pressure head of pumped material upstream of the pump gang, flow constrictions of an intermittent or changing nature downstream of the pump gang of the like. By using downstream concentration sensors, the pumps can provide a precisely controlled metering system. However, whatever the end-use, such control is maintained, according to this invention, by a relatively simple mechanism which derives basically from the ability to sense the position and speed of the actuator piston, and to control the position and speed of the actuator piston responsive to sensed flow conditions.

Although the present invention has been described with reference to a specific embodiment, those of skill in the art will recognize that changes may be made thereto without departing from the scope and spirit of the invention as set forth in the appended claims.

I claim as my invention:

1. A modular double-diaphragm pump comprising:

a central housing block having first and second opposite side faces;

a plurality of inlet and outlet passages formed in said housing block;

a first flexible diaphragm secured to said first side face of said housing block;

a second flexible diaphragm secured to said second side face of said housing block;

said diaphragms defining, with said side faces, a pair of pumping chambers in fluid communication with said inlet and outlet passages;

a first drive mechanism associated with said first diaphragm, said first drive mechanism being actuable to move said first diaphragm between a pumping stroke and a suction stroke;

a second drive mechanism associated with said second diaphragm, said second drive mechanism being actuable to move said second diaphragm between a pumping stroke and a suction stroke; and control means for actuating said first and second drive mechanisms independently of one another.

2. A pump according to claim 1, further comprising a plurality of check valves in respective fluid communication with said inlet and outlet passages.

3. A pump according to claim 2, wherein said check valves comprise ball check valves.

4. A pump according to claim 1, wherein said control means comprises a microprocessor.

5. A pump according to claim 1, wherein said first and second drive mechanisms comprise piston assemblies.

6. A pump according to claim 1, wherein said first and second drive mechanisms comprise solenoid-driven piston assemblies.

7. A modular double-diaphragm pump including a pump inlet in fluid communication with a source of fluid to be pumped and a pump outlet in fluid communication with a pumped fluid destination, said pump comprising:

a central housing block having a first side face defining a first recess, and a second side face defining a second recess;

a first inlet passage formed in a central region of said central housing block, said first inlet passage having an inlet opening selectively connected in fluid communication with said pump inlet and an outlet opening formed in said first recess of said housing block;

a second inlet passage formed in a central region of said central housing block, said second inlet passage having an inlet opening selectively connected in fluid communication with said pump inlet and an outlet opening formed in said second recess of said housing block;

a first outlet passage formed in a central region of said central housing block, said first outlet passage having an inlet opening formed in said first recess of said housing block and an outlet opening in selective fluid communication with said pump outlet;

a second outlet passage formed in a central region of said central housing block, said second outlet passage having an inlet opening formed in said second recess of said housing block and an outlet opening in selective fluid communication with said pump outlet;

a first flexible diaphragm secured to said first side face of said housing block, said first diaphragm defining, with said first recess of said first side face, a first pumping chamber in fluid communication with said first inlet passage and said first outlet passage;

a second flexible diaphragm secured to said second side face of said housing block, said second diaphragm defining, with said second recess of said second side face, a second pumping chamber in fluid communication with said second inlet passage and said second outlet passage;

a first diaphragm housing secured to said first side face of said housing block, said first diaphragm housing defining, with said first diaphragm, a first drive chamber;

a second diaphragm housing secured to said second side face of said housing block, said second diaphragm housing defining, with said second diaphragm, a second drive chamber;

a first drive assembly in fluid communication with said first drive chamber, said first drive assembly being independently selectively actuable to pressurize said first drive chamber; and a second drive assembly in fluid communication with said second drive chamber, said second drive assembly being independently selectively actuable to pressurize said second drive chamber; and whereby, during operation of said pump, said first and second drive assemblies may be actuated independently of one another.

8. A pump according to claim 7, further comprising a first inlet check valve connected between said first inlet passage and said pump inlet, said first inlet check valve being actuable between a first position permitting fluid flow from said pump inlet to said first pumping chamber, and a second position preventing fluid flow from said first pumping chamber to said pump inlet.

9. A pump according to claim 8, further comprising a second inlet check valve connected between said second inlet passage and said pump inlet, said second inlet check valve being actuable between a first position permitting fluid flow from said pump inlet to said second pumping chamber, and a second position preventing fluid flow from said second pumping chambers to said pump inlet.

10. A pump according to claim 9, further comprising a first outlet check valve connected between said first outlet passage and said pump outlet, said first outlet check valve being actuable between a first position permitting fluid flow from said first pumping chamber to said pump outlet, and a second position preventing fluid flow from said pump outlet to said first pumping chamber.

11. A pump according to claim 10, further comprising a second outlet check valve connected between said second outlet passage and said pump outlet, said second outlet check valve being actuable between a first position permitting fluid flow from said second pumping chamber to said pump outlet, and a second position preventing fluid flow from said pump outlet to said second pumping chamber.

12. A pump according to claim 11, further comprising an inlet manifold connected between said first and second inlet check valves and said pump inlet.

13. A pump according to claim 12, further comprising an outlet manifold connected between said first and second outlet check valves and said pump outlet.

14. A pump according to claim 7, wherein said first and second drive assemblies comprise driven pistons.

15. A pump according to claim 14, wherein said first and second drive assemblies comprise solenoid-driven pistons.

16. A pump according to claim 7, wherein said first and second recesses of said housing block comprise substantially hemispherical recesses.

17. A pump according to claim 7, further comprising:

a first drive passage disposed between said first drive assembly and said first drive chamber; and a second drive passage disposed between said second drive assembly and said second drive chamber.

18. A method of pumping fluid from a fluid source to a fluid destination with a dual-diaphragm pump including a central housing block having first and second opposite side faces, a plurality of inlet and outlet passages formed in said housing block, a first flexible diaphragm secured to said first side face of said housing block, a second flexible diaphragm secured to said second side face of said housing block, said diaphragms defining, with said side faces, a pair of pumping chambers in fluid communication with said inlet and outlet passages, a first drive mechanism associated with said first diaphragm, said first drive mechanism being actuable to move said first diaphragm between a pumping stroke and a suction stroke, a second drive mechanism associated with said second diaphragm, said second drive mechanism being actuable to move said second diaphragm between a pumping stroke and a suction stroke, said method comprising the following steps:

actuating said first drive mechanism; and actuating said second drive mechanism independently of said step of actuating said first drive mechanism.

19. A method according to claim 18, further comprising the step of actuating said first and second drive mechanisms such that the pumping and suction strokes of said first diaphragm are substantially equal to the pumping and suction strokes of said second diaphragm.

20. A method according to claim 18, further comprising the step of actuating said first and second drive mechanisms such that the pumping and suction strokes of said first diaphragm are substantially unequal to the pumping and suction strokes of said second diaphragm.

21. In a modular double diaphragm pump receiving a drive fluid for moving two diaphragms to displace a pumped fluid, a central housing block comprising:

a first side face recess formed on a first side of said central housing block forming a first pumping chamber;

a second side face recess formed on a second side of said central housing block forming a second pumping chamber, said second side face recess being spaced from, and disposed generally parallel to, said first side face recess; and a first pair of separate fluid passages in selective fluid communication with said first side face recess for inlet and outlet of the pumped fluid and a second pair of separate fluid passages in selective communication with said second side face recess for inlet and outlet of the pumped fluid, both of said first and second pairs of passages being disposed within said central housing block at a location between said first and second side face recesses.

22. A multi-pump control system comprising:

a plurality of diaphragm pumps connected to a common output, each of said pumps being adapted for independent actuation and including a fluid pumping chamber and a drive chamber separated by a diaphragm;

a plurality of individually actuable drive assemblies respectively associated with one said drive chamber, each of said drive assemblies including a drive piston mounted for reciprocation within a drive cylinder containing driver fluid in communication with said drive chamber, said drive piston being operatively connected to an actuator assembly including an actuator piston mounted for reciprocation within an actuator cylinder, with opposite ends of said actuator cylinder being provided with ports that are selectively coupled to a source of pressurized fluid via respective electronically controlled valves;

stroke sensing means for generating a signal corresponding to the position of said actuator piston at the opposite ends of said actuator cylinder and at least one point intermediate thereof;

flow condition sensing means for generating a signal corresponding to a condition of at least one said fluid in said pump system; and control means operatively coupled to said electronically controlled valves, said stroke sensing means, and said flow condition sensing means, for selectively actuating said electronically controlled valves to control the speed and direction of movement of said actuator pistons in response to said signals generated by said flow condition sensing means.

23. A pump system comprising:

at least one diaphragm pump having a pumped fluid chamber with a fluid inlet and a fluid outlet, valves connected to regulate flow to said inlet and from said outlet, a driver fluid chamber containing driver fluid, and a flexible diaphragm separating said pumped fluid chamber from said driver fluid chamber;

a drive piston in fluid communication with said driver fluid chamber, said drive piston being actuable to selectively pressurize and depressurize said driver fluid;

a moving member operatively connected to said drive piston, the movement of said moving member corresponding to movement of said drive piston and actuating movement of said drive piston;

actuator means, connected to said moving member, for actuating movement of said moving member;

moving member sensor means operatively connected to said moving member for detecting changes in position of said moving member and for generating signals corresponding to the position of said moving member;

control means operatively connected to said actuator means and said moving member sensor means, for receiving signals generated by said moving member sensor means and for generating control signals to said actuator means to change a condition of movement of said moving member in response to said signals generated by said moving member sensor means.

24. A pump system according to claim 23, wherein said at least one pump comprises a plurality of pumps, each of which is associated with a respective drive piston, moving member, actuator means, and moving member sensor means.

25. A pump system according to claim 24, wherein each of said pumps comprises a double-diaphragm pump.

26. A pump system according to claim 2, further comprising:

flow condition sensor means for sensing a condition of the pumped fluid and for generating a signal corresponding to said condition of the pumped fluid to said control means;

wherein said control means generates control signals in response to said signals generated by said moving member sensor means and by said flow condition sensor means.

27. A pump system according to claim 26, wherein said flow condition sensor means comprises at least one flow rate sensor.

28. A pump system according to claim 26, wherein said flow condition sensor means comprises at least one pressure sensor.

29. A pump system according to claim 26, wherein said flow condition sensor means comprises at least one concentration sensor.

30. A pump system according to claim 26, wherein said flow condition sensor means comprises two different parameter sensors.

31. A pump system according to claim 23, further comprising:

flow condition sensor means for sensing a condition of the pumped fluid and for generating a signal corresponding to said condition of the pumped fluid to said control means;

wherein said control means generates control signals in response to said signals generated by said moving member sensor means and by said flow condition sensor means.

32. A pump system according to claim 31, wherein said flow condition sensor means comprises at least one flow rate sensor.

33. A pump system according to claim 31, wherein said flow condition sensor means comprises at least one pressure sensor.

34. A pump system according to claim 31, wherein said flow condition sensor means comprises at least one flow rate sensor and at least one pressure sensor.

* * * * *